US006680286B1

(12) United States Patent
Kawaguchi et al.

(10) Patent No.: US 6,680,286 B1
(45) Date of Patent: Jan. 20, 2004

(54) DETERGENT COMPOSITION COMPRISING A QUATERNARY AMMONIUM SALT OF A CARBOXYL CONTAINING POLYMER

(75) Inventors: Koji Kawaguchi, Kyoto (JP); Hiroshi Itayama, Kyoto (JP)

(73) Assignees: Sanyo Chemical Industries, Ltd., Kyoto (JP); Matsushita Electric Industrial Co., Ltd., Kadoma (JP)

( * ) Notice: Subject to any disclaimer, the term of this patent is extended or adjusted under 35 U.S.C. 154(b) by 284 days.

(21) Appl. No.: 09/711,502

(22) Filed: Nov. 14, 2000

(51) Int. Cl.[7] ..... C11D 3/37

(52) U.S. Cl. ..... 510/434; 510/276; 510/289; 510/308; 510/318; 510/322; 510/327; 510/329; 510/330; 510/331; 510/356; 510/398; 510/421; 510/477; 510/488; 510/533

(58) Field of Search ..... 510/276, 289, 510/308, 318, 322, 327, 329, 330, 331, 356, 398, 421, 434, 477, 488, 533

(56) References Cited

U.S. PATENT DOCUMENTS

| | | | | |
|---|---|---|---|---|
| 2,870,220 A | | 1/1959 | Carter | 260/615 |
| 3,308,067 A | | 3/1967 | Diehl | 252/161 |
| 3,925,262 A | | 12/1975 | Laughlin et al. | 252/526 |
| 3,929,678 A | | 12/1975 | Laughlin et al. | 252/526 |
| 4,058,489 A | * | 11/1977 | Hellsten | 252/547 |
| 4,234,465 A | * | 11/1980 | Magari et al. | 252/547 |
| 4,737,314 A | | 4/1988 | Yokoyama et al. | 252/551 |
| 4,844,744 A | * | 7/1989 | Leiter et al. | 134/40 |
| 4,919,839 A | * | 4/1990 | Durbut et al. | 252/153 |
| 4,997,641 A | * | 3/1991 | Hartnett et al. | 424/70 |
| 5,182,373 A | * | 1/1993 | Kim et al. | 536/4.1 |
| 5,470,510 A | * | 11/1995 | Willey et al. | 252/546 |
| 5,602,092 A | * | 2/1997 | Repinec, Jr. et al. | 510/434 |
| 5,747,435 A | * | 5/1998 | Patel | 510/119 |
| 5,750,484 A | * | 5/1998 | Falbaum et al. | 510/276 |
| 5,972,862 A | * | 10/1999 | Torii et al. | 510/175 |
| 6,344,435 B1 | * | 2/2002 | Miyahara et al. | 510/494 |

FOREIGN PATENT DOCUMENTS

| | | |
|---|---|---|
| CA | 2152240 | 12/1995 |
| EP | 0 043 963 | 1/1982 |
| JP | 49-22406 | 2/1974 |
| JP | 50-12479 | 5/1975 |
| JP | 51-43483 | 11/1976 |
| JP | 53-119809 | 10/1978 |
| JP | 1-132692 | 5/1989 |
| JP | 3-128997 | 5/1991 |
| JP | 3-215600 | 9/1991 |
| JP | 3-254828 | 11/1991 |
| JP | 6-116587 | 4/1994 |
| JP | 6-346097 | * 12/1994 |
| JP | 7-118689 | 5/1995 |
| JP | 7-278597 | * 10/1995 |
| WO | 00/18857 | 4/2000 |

* cited by examiner

*Primary Examiner*—Charles Boyer
(74) *Attorney, Agent, or Firm*—Finnegan, Henderson, Farabow, Garrett, & Dunner, L.L.P

(57) ABSTRACT

Liquid detergent compositions, are disclosed, comprising a surfactant and a builder mainly comprised of a quaternary ammonium salt of a carboxyl-containing polymer, which has good compatibility with surfactants and is capable of providing excellent detergency, especially, against mud dirt in washing clothes.

Detergent compositions, are also disclosed, containing an alkoxylated alcohol nonionic surfactant having a specific distribution constant and narrow molecular weight distribution or an anionic surfactant derived therefrom, together with one or more of a quaternary ammonium or organic amine salt of a carboxyl group-containing polymer, a cationic surfactant and a quaternary ammonium or organic amine salt of a low molecular weight polycarboxylic acid, whereby detergency is synergistically enhanced.

16 Claims, No Drawings

DETERGENT COMPOSITION COMPRISING A QUATERNARY AMMONIUM SALT OF A CARBOXYL CONTAINING POLYMER

BACKGROUND OF THE INVENTION

1. Field of the Invention

This invention relates to detergent compositions. More particularly, it relates to a liquid detergent compositions containing an organic polyelectrolyte builder, which are especially useful for washing clothes.

2. Description of the Prior Art

Heretofore, there have been known water-soluble salts (such as alkali metal, ammonium or amine salts) of polymeric polycarboxylic acids (such as polyacrylic acid, polyitaconic acid, polymaleic acids, copolymers thereof and the like as a builder for detergent.

SUMMARY OF THE INVENTION

It is an object of the present invention to provide a builder compatibile with surfactants.

It is another object of this invention to provide a liquid detergent composition of improved compatibility.

It is still another object of this invention to provide a detergent composition of low foaming properties.

It is yet another object of the invention to provide a detergent composition of improved detergency to mud dirt.

It is further object of the present invention to provide a detergent composition useful for washing fibrous material, fabrics or clothes.

It is still further object of this invention to provide a detergent composition particularly suitable for use within centrifugal washers.

Briefly, these and other objects of this invention as hereinafter will become more readily apparent have been attained broadly by a liquid detergent composition, which comprises a surfactant and a builder, at least 30% by weight of said builder comprising a quaternary ammonium salt (A) of a carboxyl-containing polymer.

In another aspect of the present invention embraces a detergent composition, which comprises a specific nonionic surfactant (Bn) and/or an anionic surfactant (Dn) derived therefrom, and at least one of a quaternary ammonium salt (A) or an organic amine salt (A') of a carboxyl group-containing polymer, a cationic surfactant (C), a quaternary ammonium or organic amine salt (E) of a low molecular weight polycarboxylic acid and another quaternary ammonium or organic amine salt (F). Said surfactant (Bn) is an adduct prepared by adding an alkylene oxide (b1) to an aliphatic alcohol (a1). Said adduct satisfys the following inequality (I) or (II) and having a distribution constant (c), calculated by the following equation (III), of 2.0 or less.

$$Mw/Mn \leqq 0.030Ln(v)+1.010(v<10) \quad \text{(I)}$$

$$Mw/Mn \leqq -0.026Ln(v)+1.139(v \geqq 10) \quad \text{(II)}$$

$$c=(v+n_o/n_{oo}-1)/\{Ln(n_{oo}/n_o)+n_o/n_{oo}-1\} \quad \text{(III)}$$

In the above inequalities and equation, v is the average addition molar number of (b1) added to 1 mole of (a1), $n_{oo}$ is the molar number of (a1) used in the reaction, and no is the molar number of the unreacted (a1).

In the above and hereinafter, Mw and Mn represent a weight average molecular weight and a number average molecular weight, respectively, as determined by gel permeation chromatography (hereinafter referred to as GPC); and unreacted (a1) is determined by gas chromatography (hereinafter referred to as GC).

DETAILED DESCRIPTION OF THE PREFERRED EMBODIMENTS

Suitable carboxyl-containing polymers constituting said quaternary ammonium salt (A) or said organic amine salt (A') include polymers of at least one ethylenically unsaturated carboxyl-containing monomer, and copolymers of at least one ethylenically unsaturated carboxyl-containing monomer with at least one other polymerizable monomer.

Suitable ethylenically unsaturated carboxyl-containing monomers include, for example, α,β-unsaturated monocarboxylic acids, such as (meth)acrylic and crotonic acids; dicarboxylic acids, such as maleic, fumaric, itaconic, citraconic, mesaconic, methylenemalonic and cinnamic acids, tricarboxylic acids, such as aconitic acid; dicarboxylic anhydrides, such as maleic, itaconic and citraconic anhydrides; half esters of dicarboxylic acid as mentioned above with monohydric alcohol (e.g. alkanols, cellosolves and carbitols, containing 2 to 16 carbon atoms), such as monobutyl maleate, monoethylcarbitol maleate and the like, fumarates and itaconates corresponding to these maleates; as well as combinations of two or more of these monomers. Among these, preferred are α, β-unsaturated monocarboxylic acids, particularly (meth)acrylic acids. [In the above and hereinafter, "(meth)acrylic" represents "acrylic" and/or "methacrylic", and similar expressions are used hereinafter.] The most preferred is acrylic acid.

Suitable other polymerizable monomers are inclusive of water-soluble (or hydrophilic) and water-insoluble (or hydrophobic), nonionic and anionic monomers.

Examples of suitable other polymerizable monomers include nonionic ones as the following (a)–(g) and anionic ones as the following (h):

(a) ethylenically unsaturated aromatic hydrocarbon monomers: styrenes, such as styrene, α-methylstyrene, vinyltoluene and the like; and vinylnaphthalenes;

(b) ethylenically unsaturated aliphatic hydrocarbon monomers containing 2–20 carbon atoms: alkenes, such as ethylene, propylene, butene, isobutylene, pentene, heptene, hexene, diisobutylene, octene, dodecene and octadecene; alkadienes, such as butadiene, hexadiene and isoprene;

(c) ethylenically unsaturated alicyclic hydrocarbon monomers containing 5–15 carbon atoms: cyclopentadiene, pinene, limonene, indene, bicyclopentadiene, ethylidene-norbornene and the like;

(d) ethylenically unsaturated esters: including alkyl esters of ethylenically unsaturated carboxylic acids (as mentioned above) containing 1–50 carbon atoms in the alkyl: alkyl (meth)acrylates, such as methyl, ethyl, propyl, butyl, 2-ethylhexyl, dodecyl, hexadecyl, heptadecyl and eicosyl (meth)acrylates, and crotonates, dimaleates, difumarates and diitaconates corresponding to these (meth)acrylates; and carboxylates of ethylenically unsaturated alcohols, such as vinyl and (meth) allyl acetates;

(e) ethylenically unsaturated monomers containing a hydroxyl group and/or a (poly)oxyalkylene group having a molecular weight of 44 to about 2000 [having 1 to 30 or more units of one or more oxyalkylene groups containing 2 to 4 carbon atoms (hereinafter referred to as $C_{2-4}$; similar expressions being used hereinafter) which may be present either random-wise or block-wise in case of two or more oxyalkylene groups]: hydroxyalkyl($C_{2-6}$) esters, cellosolve esters, carbitol esters, polyoxyalkylene($C_{2-4}$) esters and (poly) oxyalkylene($C_{2-4}$)-monoalkyl($C_{1-20}$)ether esters of ethylenically unsaturated carboxylic acids (as above), such as hydroxyethyl and hydroxypropyl (meth)acrylates, mono(meth)acrylates of polyethylene glycol (MW: 300) [hereinafter referred to as PEG (300), similar expressions being used hereinafter], mono(meth) acrylates of polypropylene glycol (MW: 500) [hereinafter referred to as PPG (500), similar expressions being used hereinafter], cellosolve (meth) acrylates, carbitol (meth)acrylates, decaethylene glycol monomethylether (meth)acrylates, triacontaethylene glycol monolaurylether (meth)acrylates and the like, and crotonates, dimaleates, difumarates and diitaconates corresponding to these (meth)acrylates; ethylenically unsaturated hydrocarbon mono-ols, such as alkenols [e.g. vinyl and (meth)allyl alcohols] and hydroxystyrenes, and (poly)oxyalkylene($C_{2-4}$) ethers of them;

(f) amide-containing ethylenically unsaturated monomers: unsubstituted and substituted amides of ethylenically unsaturated carboxylic acids (as mentioned above), such as (meth)acrylamides and N-methylol (meth)acrylamides;

(g) other nonionic monomers, for example, nitrile-containing monomers, such as (meth)acrylonitriles; halogen-containing monomers, such as halogen-substituted styrenes such as dichlorostyrene, vinyl and vinylidene halides such as vinyl chloride and vinylidene chloride; and so on;

(h) ethylenically unsaturated monomers containing a sulfonic acid group or sulfate group: sulfonic group-containing monomers, for example, ethylenically unsaturated hydrocarbonsulfonic acids which may contain a hydroxyl-substituent and/or ether linkage, including alkenesulfonic acids such as vinylsulfonic and (meth)allylsulfonic acids, and aromatic ones, such as styrenesulfonic and α-methyl-styrenesulfonic acids, and hydroxy-substituted alkenyloxy-alkanesulfonic acids such as 2-hydroxy-3-(meth)allyloxy-propanesulfonic acid; sulfo-containing acrylic monomers, including (meth)acrylates and (meth) acrylamides containing sulfonic acid group and optionally hydroxyl-substituent, such as sulfopropyl and sulfoethyl (meth)acrylates, 2-hydroxy-3-(meth) acryloyloxy-propanesulfonic acids and 2-(meth) acryloylamino-2,2-dimethylethanesulfonic acids; and sulfate group-containing monomers, for instance, sulfates of polyoxyalkylene mono(meth)acrylates and sulfates of polyoxyalkylene mono(meth)allyl ethers, having 1 to 30 or more units of one or more oxyalkylene ($C_{2-4}$) groups (in case of two or more oxyalkylene groups, they may be present either random-wise or block-wise) in the polyoxyalkylene moiety, and the like.

Among these other polymerizable monomers, preferred are water-soluble nonionic monomers and particularly anionic monomers, especially acryloylamino-2,2-dimethylethanesulfonic acid (=2-acrylamido-2-methylpropanesulfonic acid, hereinafter referred to as AMPS).

Among carboxyl-containing polymers, preferred are polymers of at least one carboxyl-containing monomer, but there may also be used copolymers of at least one carboxyl-containing monomer with one or more other polymerizable monomers.

Carboxyl-containing polymers contain, as constituent units, said carboxyl-containing monomer in an amount of usually at least 50 mole %, preferably at least 70%, more preferably at least 90%, and said other monomer in an amount of usually 0–50 mole %, preferably 0–30%, more preferably 0–10%, which may vary depending upon the kind of said other monomer. The content of water-insoluble (hydrophobic) monomer [the above (a)–(d) and (g)] is usually 0–10 mole %, preferably 0–5%, more preferably 0–1%. The content of said other anionic monomer (h) is usually 0–20 mole %, preferably 0–10%, more preferably 0–7%.

Carboxyl-containing polymers have an Mn of usually about 1,000 to about 100,000 preferably about 3,000 to about 30,000 and an Mw of generally about 1,100 to about 150,000, preferably about 3,300 to about 40,000. The polymers have an acid value of usually at least 250, preferably 500–970, more preferably 550–900, most preferably 700–780.

Suitable quaternary ammonium salt (A) include ones having a quaternary ammonium cation represented by the general formula:

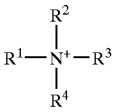

(1)

In the formula (1), $R^1$ represents a hydrocarbyl group selected from the group consisting of aliphatic hydrocarbyl ($C_{1-18}$), cycloalkyl($C_{4-12}$) and benzyl groups. $R^2$, $R^3$ and $R^4$ are independently selected from the group consisting of aliphatic hydrocarbyl($C_{1-18}$) groups, hydroxyalkyl($C_{2-8}$) groups and polyoxyalkylene group represented by a formula: —($A^1$O)n-Z, wherein $A^1$ is an alkylene($C_{2-4}$) group, Z is a hydrogen atom or an acyl($C_{1-18}$) group, and n is an integer of 2–50, preferably 2–10; or two or three of $R^2$, $R^3$ and $R^4$ may be joined to form a heterocyclic ring together with the quaternary nitrogen atom.

Suitable aliphatic hydrocarbyl groups of $R^1$, $R^2$, $R^3$ and $R^4$ include, for example, straight-chain and branched alkyl and alkenyl groups, such as methyl, ethyl, n- and iso-propyl, n-, iso- and sec-butyl, hexyl, octyl, 2-ethylhexyl, n- and iso-nonyl, n- and iso-decyl, n- and iso-undecyl, n- and iso-dodecyl, n- and iso-tridecyl, n- and iso-tetradecyl, n- and iso-pentadecyl, n- and iso-hexadecyl, n- and iso-octadecyl, octenyl, dodecenyl, tetradecenyl, hexadecenyl and octadecenyl (=oleyl) groups. Examples of suitable cycloalkyl groups of $R^1$ include cyclopentyl and cyclohexyl groups. Typical examples of suitable hydroxyalkyl groups of $R^2$, $R^3$ and $R^4$ are β-hydroxyalkyl groups, such as 2-hydroxyethyl, 2-hydroxypropyl and 2-hydroxybutyl groups. Suitable alkylene groups $A^1$ are inclusive of ethylene, 1,2- and 1,3-propylene, and 1,2-, 2,3-, 1,3- and 1,4-butylene groups, as well as combinations of two or more of these alkylene groups, which may be present either random-wise or block-wise. Suitable acyl group of Z include, for example, carboxylic acid acyl, such as formyl, acetyl, propionyl, butyryl, valeryl, lauroyl and stearoyl groups. Exemplary of suitable heterocyclic rings formed through joining of two or three of $R^2$, $R^3$ and $R^4$ together with the quaternary nitrogen atom are five- or six-membered rings, including ones formed by joining of $R^2$ and $R^3$, such as morpholinium, piperidinium and pyrrolidinium rings; and ones formed by joining of $R^2$, $R^3$ and $R^4$, such as pyridinium rings.

Illustrative of suitable quaternary ammonium cations include tetraalkyl($C_{1-18}$) ammoniums, such as trimethylethyl-, triethylmethyl-, trimethylhexyl-, trimethyloctyl-, tributyloctyl-, trimethyldecyl-, trimethyltetradecyl-, trimethylcetyl- and methyltrioctyl-ammoniums; cycloalkyl($C_{4-12}$) dialkyl($C_{1-6}$) ammoniums, such as N,N-dimethylcyclohexyl- and N,N-diethylcyclohexyl-ammoniums; trihydroxyalkyl($C_{2-8}$) alkyl ($C_{1-6}$) ammoniums, such as trihydroxyethylhexyl-ammonium; and heterocylic ammoniums, such as hydroxyalkyl ($C_{2-8}$)alkyl($C_{1-6}$)morpholiniums, hydroxyalkyl($C_{2-8}$)alkyl($C_{1-6}$) piperidiniums, hydroxyalkyl ($C_{2-8}$)alkyl($C_{1-6}$)pyrrolidiniums and alkyl($C_{1-6}$)pyridiniums.

Suitable organic amine salts (A') include ones having an organic amine cation represented by the general formula (1) wherein $R^1$ is hydrogen atom.

Suitable organic amines constituting said organic amine salt include, for example, aliphatic amines, alicyclic amines and heterocyclic amines, and adducts of alkylene oxide (hereinafter referred to as AO) to these amines.

Suitable aliphatic amines include mono-, di- and tri-alkyl ($C_{1-18}$)amines, for example, monoalkylamines such as hexyl and octylamines, alkylamines such as methylhexyl and methyloctylamines, trialkylamines such as dimethylhexyl, dimethyloctyl, dimethyllauryl and dimetylcetylamines; alkanolamines, for example, mono-, di- and tri-hydroxyalkyl ($C_{2-8}$)amines, such as monoethanolamine, diethanolamine and triethanolamine (hereinafter referred to as TEA).

Illustrative of suitable alicyclic amines are cycloalkylamines($C_{4-12}$), such as cyclobutylamine, cyclohexylamine, cyclopentylamine and cyclooctylamine, cycloalkyl($C_{4-12}$)mono- or di-alkyl($C_{1-6}$)amines, such as N-methylcyclohexylamine and N-ethylcyclohexylamine.

Examples of suitable heterocyclic amines include ones containing 4 to 10 carbon atoms, such as morpholine, piperidine, pyrrolidine and pyridine.

Suitable examples of AO to be added to these amines include AO($C_{2-4}$)s, such as ethylene oxide, propylene oxide and 1,2-, 2,3-, 1,3- and 1,4-butylene oxides (hereinafter referred to as EO, PO and BO, respectively), as well as combinations of two or more of them (random-wise or block-wise). Preferred is EO. In general, 1 to 5 moles, preferably 1 to 2 moles of AO is added per active hydrogen atom of amine. Illustrative of suitable AO adducts are dihydroxyethylhexylamine and hydroxyethylmethylhexylamine.

Among quaternary ammonium salts and organic amine salts, preferred are salts (more preferably quaternary ammonium salts) derived from aliphatic or alicyclic amines or AO adducts thereof, particularly those having alkyl($C_{1-12}$) groups, at least one of which is an alkyl($C_{2-12}$) group. Especially preferred are triethylmethylammonium, triethyloctylammonium, trimethyldecylammonium, trimethylhexylammonium and trimethyloctylammonium salts. Most preferred is trimethylethylammonium salt.

Quaternary ammonium salts and organic amine salts of carboxyl-containing polymer can be prepared by any known methods. Suitable methods include 1) those by preparing a carboxyl-containing polymer, followed by converting the carboxyl-containing polymer into a salt thereof through quaternarization or neutralization; 2) those by (co) polymerizing a carboxyl-containing monomer in the form of a quaternary ammonium salt or organic amine salt optionally with one or more other monomer; and 3) those by (co) polymerizing a carboxyl-containing monomer in the form of a partial quaternary ammonium or organic amine salt (or a mixture of a carboxyl-containing monomer with a salt thereof) having a neutralization degree of usually 30–80% (preferably 60–80%, particularly 70%) optionally with one or more other monomer to prepare a carboxyl-containing polymer in the form of a partial salt, followed by further quaternarizing or neutralizing the resulting polymer to convert the residual free carboxyl groups therein into a salt having a desired neutralization degree. [In the above and hereinafter, the term "neutralization degree" is used broadly in the meaning of degree of anion exchange (quaternarization) or neutralization (mole %).] Among these, preferred are the methods 3) in view of providing oderless products.

Carboxyl-containing monomers and carboxyl-containing polymers may be converted into quaternary ammonium salts either through neutralization with a quaternary ammonium hydroxide or through anion exchange with a quaternary ammonium carbonate, and into organic amine salts through neutralization with an organic amine.

Quaternary ammonium hydroxides can be produced by reacting an alkali metal hydroxide (such as sodium or potassium hydroxide) with a quaternary ammonium halide obtainable by reacting a halide [for example, alkyl($C_{1-10}$) or benzyl halide, such as methyl chloride, ethyl bromide or benzyl chloride) with a tertiary amine (as mentioned above). Quaternary ammonium carbonates can be prepared by reacting a dialkyl($C_{1-6}$) carbonate (such as dimethyl or diethyl carbonate) with a tertiary amine (as mentioned above), for instance, in accordance with methods described in Italian Pat.No.1,153,530 incorporated herein by reference.

The anion exchange or neutralization (the reaction of a carboxyl-containing monomer or polymer with a quaternary ammonium carbonate, a quaternary ammonium hydroxide or an organic amine) may be carried out within a solution in a solvent. Suitable solvents include, for example, water; alcohols, such as methanol, ethanol and iso-propyl alcohol; ketones, such as acetone and methyl isobutyl ketone; ethers, such as diethyl ether and tetrahydrofuran; aliphatic hydrocarbons, such as hexane and heptane; and aromatic hydrocarbons, such as toluene and xylene, etc.); as well as mixtures of two or more of these solvents, such as mixture of methanol and iso-propyl alcohol. Among these, preferred are water and alcohols, particularly methanol, iso-propyl alcohol and mixture of them; more preferred are mixture of water with methanol and especially water.

Said carboxyl-containing monomer or salt thereof and optionally said other polymerizable monomer can be polymerized using any of known polymerization techniques, such as bulk polymerization, emulsion polymerization, suspension polymerization and solution polymerization, preferably solution polymerization. Exemplary of suitable solvents employed in solution polymerization are water;

hydrophilic organic solvents, such as lower ($C_{1-4}$) alcohols (e.g. iso-propanol), ketones (e.g. acetone), esters (e.g. ethyl acetate); mixture thereof with water (weight ratio=1/9–9/1). Preferred are mixture of lower alcohol (particularly iso-propanol) with water (weight ratio=preferably 9/1–5/5, most preferably 8/2–6/4) and particularly water.

Polymerization may be carried out in the presence of a radical initiator and optionally a chain-transfer agent.

Illustrative of suitable radical initiators are azo compounds, such as 2,2-azobisisobutyronitrile, 2,2'-azobis (2,4-dimethylvaleronitrile), 2,2'-azobis(2-methylbutyronitrile), 2,2'-azobis(2,4,4-trimethylpentane), dimethyl 2,2'-azobis(2-methylpropionate), 2,2'-azobis[2-(hydroxymethyl)propionitrile] and 1,1'-azobis(1-acetoxy-1-phenylethane); peroxides, including organic ones, such as dibenzoyl peroxide, dicumyl peroxide, bis(4-t-butylcyclohexyl)peroxy dicarbonate, benzoyl peroxide, lauroyl peroxide and persuccinic acid, and inorganic ones, such as persulfates (e.g. sodium persulfate), perphosphates and hydrogen peroxide; and redox initiators composed of a combination of these peroxides with reducing agents, for examples, ascorbic acid (salts), Rongalit, hypophosphorous acid (salt), sulfurous acid (salt), bisulfurous acid (salt) and ferrous salt (e.g. ferrous chloride); as well as combination of two or more of these initiators. Among these, preferred are redox initiators, particularly combination of peroxides (especially hydrogen peroxide) with ascorbic acid. Radical initiator is used in an amount of usually 0.01 to 20% by weight, preferably 0.05 to 10%, more preferably 0.1 to 2%, based on the total weight of the monomers.

Suitable chain-transfer agents include, for example, sulfur-containing ones, such as laurylmercaptan, thioglycolic acid, mercaptoethanol, dimercaptans derived from (poly)alkylene glycol having 1–30 oxyalkylene($C_{2-4}$) units (e.g. triethylene glycol dimercaptan) and the like. Among these, preferred are (poly)alkylene glycol dimercaptans, particularly triethylene glycol dimercaptan. Chain-transfer agent is used in an amount of usually 0.01 to 10 mole %, preferably 0.05 to 3%, based on the total moles of the monomers.

Polymerization temperature is generally 50–300° C., preferably 60–250° C. Solution polymerization may be done at a temperature higher than or below the boiling point (at normal pressure) of the solvent, but preferably at a temperature higher than the boiling point.

In case where a quaternary ammonium salt or organic amine salt of carboxyl-containing polymer is used together with a nonionic surfactant, neutralization or anion exchange of the carboxyl-containing monomer or polymer may be carried out within a mixture thereof with the nonionic surfactant.

The neutralization degree of carboxyl groups in the monomer or polymer is usually 30 to 100%, preferably 60 to 100%, most preferably 80 to 100%.

Among these preparation methods, preferred are those by anion exchange with a quaternary ammonium carbonate. A specific example for preparation of a quaternary ammonium salts of a carboxyl-containing polymer, in the case of a trimethyloctylammonium salt of polyacrylic acid, is as follows: Into a pressure vessel, are charged dimethyloctylamine (1 mole) and dimethyl carbonate (1 mole or more) together with methanol, and reacted at an elevated temperature (at about 120° C.) under pressure (about 5 kg/cm$^2$) to obtain a solution in methanol of trimethyloctylammonium carbonate. Then, the solution is added at a temperature of 80–90° C. gradually to an aqueous solution of polyacrylic acid, whereby carbon dioxide is simultaneously generated vigorously. Generated carbon dioxide and methanol are distilled off to obtain an aqueous solution of trimethyloctylammonium salt of polyacrylic acid.

Said quaternary ammonium salt (A) and said organic amine salt (A') of carboxyl-containing polymers in this invention have an Mn of usually about 1,000 to about 110,000 preferably about 3,000 to about 33,000 and an Mw of generally about 1,100 to about 165,000, preferably about 3,300 to about 44,000.

Said quaternary ammonium salt (A) and said organic amine salt (A') preferably have a solubility parameter (hereinafter referred to as SP) in the range of 8.0 to 12.0, particularly 8.5 to 11.5, in view of their compatibility with surfactants and detergency performance. SP can be determined by the following equation:

$$SP=(\Delta H/V)^{1/2} \quad \text{(IV)}$$

wherein ΔH is a molar heat of vaporization (cal), and V is a molar volume (cm$^3$).

SP can be calculated from the total (ΔH) of the molar heat of vaporization ($\Delta e_i$) of atomic groups and the total (V) of the molar volume ($\Delta V_i$) of atomic groups, as described in "POLYMER ENGINEERING AND SCIENCE", 1974, Vol.14, No.2, ROBERT F. FEDORS, (pp.151–153).

Suitable surfactants used together with (A) include nonionic, cationic, anionic and amphoteric (or zwitter-ionic) surfactants, as well as mixtures of two or more of them.

Examples of nonionic surfactants (B), cationic surfactants (C), anionic surfactants (D) and amphoteric surfactants are as follows. Typical examples of these and similar surfactants are described in U.S. Pat. Nos. 4,331,447 and 3,929,678 and French Patent No.1,427,133, which are herein incorporated by reference.

Examples of suitable nonionic surfactants (B) are:

(i) AO adduct type nonionic surfactants, having a (poly) oxyalkylene moiety comprising oxyalkylene($C_{2-4}$) units [preferably oxyethylene units, and combination thereof with oxyalkylene($C_{3-4}$) units), for example,
  - (i-1) (poly)oxyalkylene ethers [containing 1 to 30 or more oxyalkylene($C_{2-4}$) units] of aliphatic alcohols ($C_{8-18}$), such as those represented by the general formulae (2) and (3) described bellow;
  - (i-2) (poly)oxyalkylene ethers [containing 1 to 30 or more oxyalkylene($C_{2-4}$) units] of alkylphenols having alkyl($C_{1-12}$) group(s), such as EO adducts of mono- and di-nonylphenols;
  - (i-3) (poly)oxyalkylene esters [containing 1 to 30 or more oxyalkylene($C_{2-4}$) units] of fatty acids($C_{8-18}$), such as PEG mono- and di-laurates, PEG mono- and di-stearates, and PEG mono-and di-oleates;
  - (i-4) (poly)oxyethylene ethers (containing 1 to 50 or more oxyethylene units) of polyoxypropylene polyols [such as PPG and PO adducts of alkylene($C_{2-6}$) diamine] having an equivalent weight (a molecular weight per hydroxyl group) of 100 to 2000 or more, such as Pluronic type surfactants [e.g. EO adducts of PPG (900–2,900)] and Tetronic type surfactants [e.g. EO adducts of. polyoxypropylated ethylene diamine (MW: 2500–3000)];
  - (i-5) polyoxyalkylene [containing 3 to 30 or more oxyalkylene($C_{2-4}$) units] alkyl($C_{6-20}$) allyl ethers, such as PEG dodecyl allyl ether; and
  - (i-6) (poly)oxyalkylene ethers [containing 1 to 30 or more oxyalkylene($C_{2-4}$) units per hydroxyl group] of polyhydric alcohols($C_{2-30}$) having 2 to 8 or more hydroxyl groups (such as sorbitan) fatty acid($C_{8-24}$) ester (such as EO adducts of sorbitan mono-, di- and tri-laurate and EO adducts of sorbitan mono-, di- and tri-oleate;

(ii) polyhydric alcohol type nonionic surfactants, for instance,
  - (ii-1) polyhydric alcohol($C_{2-30}$) having 2 to 8 or more hydroxyl groups (such as glycerol and sorbitan) fatty acid($C_{8-24}$) esters, such as glycerol monostearate, glycerol monooleate, sorbitan monolaurate and sorbitan monooleate; and
  - (ii-2) alkanolamide type surfactants, of mono- and di-alkanol amines having hydroxyalkyl($C_{2-4}$) group (s) with fatty acid($C_{8-24}$), such as lauric acid monomethanolamide and lauric acid diethanolamide; and (iii) other nonionic surfactants, for example, (iii-1) amine oxide surfactants, such as alkyl($C_{8-18}$) di(hydroxy)alkyl($C_{1-3}$)amine oxides;

(iii-1) phosphine oxide surfactants, such as alkyl($C_{8-18}$)di-(hydroxy)alkyl($C_{1-3}$) phosphine oxides; and (iii-1) sulfoxide surfactants, such as alkyl($C_{8-18}$) (hydroxy)alkyl($C_{1-3}$) sulfoxides.

Typical examples of these and similar nonionic surfactants are described in U.S. Pat. Nos. 4,331,447 and 3,929,678, which are herein incorporated by reference.

Among nonionic surfactants, preferred are AO adduct types (i), particularly (poly)oxyalkylene ethers of aliphatic alcohols (i-1).

Among these, more preferred are nonionic surfactants (B1) represented by the following general formula (2), particularly those of the following general formula (3).

$$R—O—(A^1O)p\text{-}H \quad (2)$$

$$RO—\{(C_2H_4O)n.(A^2O)m\}—(C_2H_4O)q\text{-}(A^2O)r\text{-}H \quad (3)$$

In the formulae (2) and (3), R represents an aliphatic hydrocarbyl group, containing 8 to 18 (preferably 10 to 18) carbon atoms in view of detergency. Suitable aliphatic hydrocarbyl groups include straight-chain and branched alkyl groups, unsaturated aliphatic hydrocarbyl groups (such as alkenyl, alkadienyl, alkatrienyl and alkapolyenyl groups) and cycloaliphatic hydrocarbyl groups. Examples of these aliphatic hydrocarbyl groups include residues R of aliphatic alcohols of the formula R—OH as mentioned bellow.

In the formula (2), p is an integer of 1–30, preferably 6 to 20, for better detergency. $A^1$ represents one or more alkylene ($C_{2-4}$) groups, including ethylene, propylene and 1,2-, 2,3-, 1,3- and 1,4-butylene groups. In case of p being 2 or more, plural ($A^1O$) may be the same or different, and different ($A^1O$)s may be present either random-wise or block-wise, or combination of them.

In the formula (3), $A^2$ is one or more alkylene($C_{3-4}$) groups, including propylene and 1,2-, 2,3-, 1,3- and 1,4-butylene groups; n is 0 or an integer of 1–12 (preferably 1 to 10) and q is an integer of 1–16 (preferably 2 to 12), in view of detergency; r is 0 or an integer of 1–15 (preferably 1–8) and m is 0 or an integer of 1–6 (preferably 1–4), for imparting better fluidness to the detergent; (m+n+q) is in the range of 1–30 (preferably 6 to 20) and (n+q)/(m+n+q+r) is at least 0.5 (preferably 0.7–0.9), for providing better detergency. In case of n being not equal to 0, $\{(C_2H_4O)n.(A^2O)m\}$ represents ($C_2H_4O$) and ($A^2O$) being present either random-wise or block-wise.

These (poly)oxyalkylene ethers of aliphatic alcohols (i-1) can be prepared using a conventional AO addition reaction. Namely, they can be produced by adding an AO to an aliphatic alcohol of the formula R—OH at an elevated temperature (such as 70–200° C.) in the presence of a catalyst. Suitable catalysts include conventional ones, for example, alkaline or basic catalyst, including hydroxides and carbonates of alkali metals (e.g. lithium, sodium, potassium and cesium) such as KOH, and amines, such as trimethyamine and triethylamine, and acidic catalysts, such as $BF_3$; and catalysts, capable of providing an adduct of a narrower molecular weight distribution than that can be afforded by conventional catalysts, as described bellow.

As the AO, there can be used any of EO, PO, BO and two or more of them (such as combination of EO with PO and/or BO), which may be added random-wise (such as EO/PO, EO/BO and EO/PO/BO), block-wise (such as subsquent additions of PO-EO, EO-PO, EO-PO-EO, PO-EO-PO and EO-PO-EO-PO) or combination thereof (such as EO/PO-EO and EO/PO-EO-PO). [In the above and hereinafter, EO/PO represents random addition of EO and PO, PO-EO represents block addition of PO follwed by EO, EO/PO-EO represents random addition of EO and PO followed by block addition of EO, and similar expressions are used.] Among these, preferred are EO alone, EO-PO, and particularly EO-PO-EO, EO/PO-EO and EO/PO-EO-PO. Most preferred are EO-PO-EO and EO/PO-EO.

Suitable aliphatic alcohols of the formula R—OH include natural and synthetic, straight-chain and branched, saturated and unsaturated, primary, secondary and tertiary alcohols, containing 8–18 (preferably 10–18) carbon atoms, and mixtures of two or more of them.

Illustrative of suitable aliphatic alcohols are 1) saturated aliphatic primary alcohols, including natural and synthetic, straight-chain and branched ones, for example, octyl, 2-ethyl-hexyl, decyl, lauryl, myristyl, palmityl, stearyl and 1,1-dimethyloctyl alcohols; Ziegler alcohols (synthesized using a Ziegler catalyst), such as ALFOL 1214, produced by CONDEA; and oxo alcohols [prepared by oxo process (for instance, the process described in British Pat.No.1,007,324 incorporated by reference)] and Guerbet alcohols (prepared by Guerbet condensation of alkanols), such as Dobanol 23, 25 and 45 produced by Mitsubishi Petro-chemical Co., Ltd., Tridecanol produced by Kyowa Hakko Kogyo Co., Ltd., Oxocol 1213, 1215 and 1415 produced by Nissan Chemical Co., Ltd. and Diadol 115-L, 115H and 135 produced by Mitsubishi Chemical Corp.; 2) saturated aliphatic secondary alcohols, for instance, ones obtained by oxidation of n-paraffin through the method as described in Oil Chemistry, Vol. 21, No. 5, pp. 233–242 (1972), or from petroleum hydrocarbons separated by LINDE IsoSiv process, such as those having linear alkyl($C_{11-15}$) portion, of TERGITOL S series (e.g. TERGITOL 15-S-9) produced by UNION CARBIDE Corp.; 3) unsaturated aliphatic alcohols, including natural and synthetic, alkenyl, alkadienyl, alkatrienyl and alkapolyenyl alcohols, for example, octenyl, decenyl, dodecenyl, tridecenyl, pentadecenyl, oleyl and linoleyl alcohols; and alcohols prepared by reduction method, such as Hicol 40 and 60 produced by Kyowa Oil & Fat Co., Ltd. and Angecol 50A manufactured by Shin-Nippon Rika Co., Ltd.; and 4) cycloaliphatic alcohols, such as ethylcyclohexyl, propylcyclohexyl, octylcyclohexyl and nonylcyclohexyl alcohols.

Among these alcohols, preferred are saturated aliphatic primary alcohols (particularly those of $C_{10-18}$), and oleyl alcohol.

Among (poly)oxyalkylene ethers of aliphatic alcohols (i-1) represented by the general formula (2), more preferred are adducts (Bn), prepared by adding an AO (b1) to an aliphatic alcohol (a1) of the formula R—OH and having a narrow molecular weight distribution (Mw/Mn ratio) satisfying the above inequality (I) or (II), particularly satisfying the following inequality (IV) or (V):

$$Mw/Mn \leqq 0.031Ln(v)+1.000 (v<10) \quad (IV)$$

$$Mw/Mn \leqq -0.026Ln(v)+1.129 (v \leqq 10) \quad (V)$$

It is further preferred that said adducts (Bn) simultaneously have a distribution constant (c), calculated by the above equation (III), of 2.0 or less, especially 1.0 or less, for achieving better surface activity.

Methods for synthesis of said adducts (Bn) having such a narrow molecular weight distribution and a low distribution constant (c) as above include 1) methods of adding an AO to an aliphatic alcohol in the presence of a catalyst capable of providing an adduct of such a narrow molecular weight distribution; 2) methods of adding 1 to 3 moles (especially about 2 moles) of an AO to an aliphatic alcohol in the presence of a catalyst capable of providing an adduct of such a narrow molecular weight distribution, followed by further adding the same or different AO in the presence of a conventional catalyst; and 3) methods of adding 1 to 3 moles of an AO to an aliphatic alcohol in the presence of a conventional catalyst, subsequently removing unreacted alcohol (for instance, through distillation), followed by further adding the same or different AO in the presence of a conventional catalyst. Among these, preferred are the methods 1) and particularly 2).

Suitable examples of catalysts capable of providing an adduct of such a narrow molecular weight distribution include calcined magnesium oxide-containing compounds (as described in JP-A 1-164,437), calcined hydrotalcite (as described in JP-A 2-71,841) and perchlorates (as described in U.S. Pat. No. 4,112,231), all incorporated herein by reference; perhalogenic acids (such as perchloric acid), sulfuric acid and nitric acid, and salts (such as magnesium, zinc and aluminum salts) of these acids; and alcoholates [for instance, alcoholates($C_{2-4}$), such as methanolate, ethanolate and n-propanolate] of di- or trivalent metals (such as magnesium, zinc and aluminum). Among these, preferred are perchlorates, particularly magnesium and aluminum perchlorates. Conventional catalysts used in the second step of the methods (2) and in the methods (3) include, for example, alkaline catalysts, such as hydroxides and alcoholates($C_{1-4}$) (e.g. methylate) of alkali metal (e.g. potassium and sodium); amine catalysts, such as trimethyl amine, triethylamine, and the like.

Examples of suitable nonionic surfactants (Bn) include those described in WO 00/18857 (PCT/JP99/05305) incorporated herein by reference.

Suitable cationic surfactant (C) include quaternary ammonium salt-type and amine-salt type cationic surfactants, for example, those represented by the general formula (7) or (8):

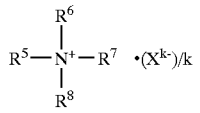

(7)

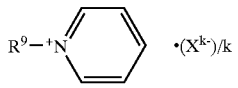

(8)

In the formula (7), $R^5$ is an organic group, selected from the group consisting of aliphatic hydrocarbyl, acyloxyalkyl, acylaminoalkyl, alkoxyalkyl and hydroxyalkyl groups, comprising a long chain aliphatic hydrocarbon moiety containing 7–24 carbon atoms (preferably 10–18 carbon atoms). $R^6$ and $R^7$ are independently selected from the group consisting of hydrogen atom, aliphatic hydrocarbyl groups containing 1–24 carbon atoms (preferably 1–18 carbon atoms), hydroxyalkyl groups containing 2 to 24 carbon atoms (preferably 2–4 carbon atoms) and polyoxyalkylene groups represented by the formula: —($A^1$O)n-Z, wherein $A^1$ is an alkylene group containing 2–4 carbon atoms, Z is a hydrogen atom or an acyl group containing 1–18 carbon atoms (preferably 1–16 carbon atoms) and n is an integer of 2–50 (preferably 5–30); preferably selected from the group consisting of alkyl($C_{1-4}$) and benzyl groups. $R^6$ and $R^7$ may be joined to form, together with the quaternary nitrogen atom, a heterocyclic ring (five- or six-membered rings, such as morpholine, piperidine and pyrrolidine rings). $R^8$ is selected from the group consisting of hydrogen atom, aliphatic hydrocarbyl groups containing 1–24 carbon atoms (preferably 1–18 carbon atoms), benzyl group, hydroxyalkyl groups containing 2 to 24 carbon atoms (preferably 2–4 carbon atoms) and polyoxy-alkylene groups represented by the formula: —($A^1$O)n-Z, wherein $A^1$, Z and n are as previously defined. In the formula (7), $R^9$ is an organic group, selected from the group consisting of aliphatic hydrocarbyl, β-hydroxyalkyl, acyloxymethyl and alkoxymethyl groups, comprising a long chain aliphatic hydrocarbon moiety containing 7–24 carbon atoms (preferably 10–18 carbon atoms). In the formulae (7) and (8), X is an anionic counter ion having a valency of k, and k is an integer of 1–3 (preferably 1).

Examples of suitable aliphatic hydrocarbyl groups of $R^5$, $R^6$, $R^7$, $R^8$ and $R^9$ include the same ones as mentioned in examples of $R^1$, $R^2$, $R^3$ and $R^4$; as well as higher alkyl, alkenyl and cycloaliphatic groups, such as n- and iso-eicosyl, docosyl, tetracosyl and eicosenyl groups, and rosin amine residue. Suitable acyloxyalkyl and acylaminoalkyl groups of $R^5$ include, for example, those having a fatty acyl($C_{8-18}$) group and alkylene($C_{2-6}$) group (e.g. ethylene, propylene and butylene groups), such as lauroyloxyethyl, stearoyloxyethyl, lauramidoethyl, stearamidoethyl, lauramidopropyl and stearamidopropyl groups. Exemplary of suitable alkoxyalkyl groups of $R^5$ are those having an alkoxy ($C_{7-18}$) group and alkylene($C_{2-6}$)group, such as lauryloxyethyl and stearyloxyethyl groups. Suitable hydroxyalkyl groups of $R^5$, $R^6$, $R^7$, $R^8$ and $R^9$ are inclusive of β-hydroxyalkyl groups, such as hydroxyethyl, hydroxypropyl, hydroxybutyl, hydroxyhexyl, hydroxyoctyl and hydroxydecyl groups. Examples of suitable polyoxyalkylene groups of the formula: —($A^1$O)n-Z are polyoxyethylene groups of the formula: —($CH_2CH_2O$)n-H and fatty esters (such as acetate, propionate and butyrate) thereof. Illustrative of suitable acyloxymethyl and alkoxymethyl groups of $R^9$ are lauryloxymethyl, hexadecyloxymethyl, stearyloxymethyl and stearoyloxymethyl groups. Suitable anionic counter ions of X include inorganic ones, for example, halide ions (such as fluoride, chloride, bromide and iodite ions), hydroxyl, nitrate, sulfate, phosphate and carbonate ions; and organic ones, for instance, carboxylate ions ($C_{1-24}$ preferably $C_{1-4}$), such as aliphatic monocarboxylate ions (formate, acetate, propionate, butyrate, isobutyrate, valerate, iso-valerate, pivalate, laurate, myrystate, palmitate, stearate, oleate and the like), aliphatic dicarboxylate ions (oxalate, malonate, succinate, adipate, sebacate and the like), and hydroxy-carboxylate ions (glycolate, lactate, tartrate, cytrate, gluconate, salicylate and the like); alkyl($C_{1-24}$ preferably $C_{1-4}$) sulfate ions, such as methosulfate and ethosulfate ions; alkyl($C_{1-24}$ preferably $C_{1-4}$) carbonate ions, such as methyl carbonate and ethyl carbonate ions; alkyl ($C_{1-24}$ preferably $C_{1-4}$) phosphate ions, such as mono- and/or di-methyl phosphate and ethyl phosphate ions; alkane or alkene($C_{1-24}$ preferably $C_{1-4}$)sulfonate and alkyl($C_{1-24}$ preferably $C_{1-4}$)benzenesulfonate ions, such as methanesulfonate, ethanesulfonate and p-toluenesulfonate ions.

Among cationic surfactants represented by the general formula (7) or (8), preferred are:

1) those of the the general formula (7), wherein $R^5$ is an alkyl, alkenyl or β-hydroxyalkyl group (preferably alkyl or alkenyl group); $R^6$ and $R^7$ are independently selected from the group consisting of hydrogen atom, alkyl, alkenyl, hydroxyalkyl and polyoxyalkylene group of the formula: —($A^1O$)n-Z; and $R^8$ is a hydrogen atom, alkyl, alkenyl, benzyl, hydroxyalkyl or polyoxyalkylene group of the formula: —($A^1O$)n-Z:

for example, salts of a primary amine of the formula $R^5$—$NH_2$ (higher amine, such as laurylamine, stearylamine, tallow amine, hydrogenated tallow amine and rosin amine), a secondary amine of the formula $R^5$—NH—$R^6$ [such as dialkylamines (e.g. dilaurylamine and distearylamine), and EO adducts of a primary amine as above] or a tertiary amine of the formula

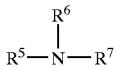

such as trialkyl amines (e.g. lauryldimethylamine, stearyldimethylamine and distearylmethylamine), and EO adducts of a primary or secondary amine as above] with an acid of the formula $H_kX$ (inorganic acids, such as hydrochloric and phosphoric acids; and organic acids, such as acetic, succinic and lactic acids), wherein $R^5$, $R^6$, $R^7$, X and k are as previously defined, such as hydrochloric acid salt of stearylmethylamine; and quaternary ammonium salts, obtainable by alkylating a tertiary amine of the above formula with an alkylating agent (a quaternarizing agent) of the formula $(R^8)_k$—X (such as methyl chloride, benzyl chloride, dimethyl or diethyl carbonate and dimethyl or diethyl sulfate, or the like), or by adding an AO ($C_{2-4}$, such as EO) to a salt of a tertiary amine of the above formula with an acid of the formula $H_kX$, wherein $R^5$, $R^6$, $R^7$, $R^8$ and X are as previously defined; including alkyl($C_{8-24}$) trimethylammonium salts, such as lauryltrimethylammonium chloride, stearyltrimethylammonium bromide and stearyltrimethylammonium methyl carbonate; dialkyl($C_{8-24}$) dimethylammonium salts, such as didecyldimethylammonium chloride, dilauryldimethylammonium chloride, dioctyldimethylammonium bromide; alkyl($C_{8-24}$) dimethylbenzylammonium salts, such as lauryldimethylbenzylammonium chloride (benzalkonium chloride); alkyl($C_{8-24}$)trihydroxyethylammonium salts, such as stearyltrihydroxyethylammonium chloride; dialkyl($C_{8-24}$) dihydroxyethylammonium salts, such as dilauryldihydroxyethylammonium acetate, and the like;

2) those of the the general formula (8), wherein $R^9$ is an alkyl, alkenyl, β-hydroxyalkyl, acyloxymethyl or alkoxymethyl group (preferably an alkyl or alkenyl group):

for instance, alkyl- and alkenyl($C_{8-24}$) pyridinium salts, such as octylpyridinium chloride, cetylpyridinium chloride, stearylpyridinium chloride and oleylpyridinium bromide; acyl($C_{8-24}$)oxymethylpyridinium salts, such as lauroyloxymethylpyridinium chloride and stearoyloxymethylpyridinium chloride; alkoxy ($C_{8-24}$)methylpyridinium salts, such as hexadecyloxymethylpyridinium chloride and stearyloxymethylpyridinium chroride; and the like;

3) those of the the general formula (7), wherein $R^5$ is an acyloxyalkyl group [particularly acyloxyethyl group, in which the acyl group has an alkyl or alkenyl($C_{8-24}$) group], such as lauroyloxyethyl and stearoyloxyethyl groups; $R^6$ and $R^7$ are the same or different hydroxyalkyl groups; and Ra is an alkyl, alkenyl, benzyl, hydroxyalkyl or polyoxyalkylene group of the formula: —($A^1O$)n-Z:

for example, salts of an acyloxyethyldihydroxyethylamine (TEA fatty acid ester, such as TEA monolaurate and TEA monostearate) with an acid of the formula $H_kX$, wherein X and k are as previously defined (such as hydrochloric acid and acetic acid); and quaternary ammonium salts, obtainable by alkylating an acyloxyethyldihydroxyethylamine as above with an alkylating agent of the formula $(R^8)_k$—X as described above; including acyloxyethylmethyldihydroxyethylammonium salts, such as capryloyloxyethylmethyldihydroxyethylammonium methyl carbonate, lauroyloxyethylmethyldihydroxyethylammonium chloride and stearoyloxyethylethyldihydroxyethylammonium ethosulfate;

4) those of the the general formula (7), wherein $R^5$ is an acylaminoalkyl group [particularly acylaminoethyl group, in which the acyl group has alkyl or alkenyl($C_{8-24}$) group], such as lauramidoethyl and stearamidoethyl groups; $R^6$ and $R^7$ are the same or different alkyl groups (particularly selected from methyl and ethyl groups); and $R^8$ is an alkyl, alkenyl, benzyl, hydroxyalkyl or polyoxyalkylene group of the formula: —($A^1O$)n-Z:

for example, salts of an acylaminoethyldiethylamine (such as lauramidoethyldiethylamine and stearamidoethyldiethylamine) with an acid of the formula $H_kX$, wherein X and k are as previously defined (such as hydrochloric and acetic acids); and quaternary ammonium salts, obtainable by alkylating an acylaminoethyldiethylamine as above with an alkylating agent of the formula $(R^8)_k$—X as described above; including acylaminoethyldiethylmethylammonium salts, such as lauramidoethylmethyldiethylammonium chloride, stearamidoethyldiethylmethylammonium methosulfate and stearamidoethyldiethylammonium acetate; and the like.

These cationic surfactants can be produced using conventional methods, for instance, by neutralizing an amine with an acid $H_kX$; by quaternalizing a tertiary amine with an alkylating agent $(R^8)_k$—X, optionally followed by anion exchainging (such as quaternalizing a tertiary amine with a dialkyl carbonate followed by anion exchainging with an acid $H_kX$; quaternalizing a tertiary amine with an alkyl halide followed by adding silver hydroxide thereto to convert the halide ion into a hydroxyl ion).

Among these cationic surfactants, preferred are those of the general formula (7), more preferred are alkyl($C_{8-18}$) trimethylammonium and dialkyl($C_{8-18}$)dimethylammonium salts, particularly lauryltrimethylammonium, cetyltrimethylammonium, stearyltrimethylammonium, dioctyldimethylammonium and didecyldimethylammonium salts, especially cetyltrimethylammonium salts.

Illustrative of suitable anionic surfactants (D) are salts of carboxylic acids (for example, saturated and unsaturated higher fatty acids($C_{6-20}$: such as lauric, stearic, oleic and rinoleic acids); carboxymethylated products of EO (1–30 moles) adducts of aliphatic alcohols ($C_{6-20}$)]; salts of sulfonic acids [for example, linear and branched alkyl($C_{6-14}$) benzene sulfonic acids, α-sulfo-carboxylic acids($C_{6-20}$: such as sulfo-succinic acid) and alkyl($C_{1-8}$) esters thereof, alkane ($C_{6-20}$)sulfonic acids, olefin($C_{14-18}$)sulfonic acids]; salts of sulfate esters (for example, alkyl($C_{10-18}$) sulfates; and sulfates of EO (1–30 moles) adducts of aliphatic alcohols ($C_{6-20}$)]; and salts of phosphate esters [for example, alkyl ($C_{6-18}$) phosphates; and phosphates of EO (1–30 moles) adducts of aliphatic alcohols ($C_{6-20}$) and alkyl($C_{6-14}$) phenols]. Suitable salts in these anionic surfactants include salts of lower amines, for example, mono-, di- and trialkyl($C_{1-4}$) and/or alkanol($C_{2-4}$) amines, as mentioned in the above amine salt in said (A'); alkali and alkaline earth metal salts, such as sodium and calcium salts; ammonium salt; and mixed salts of two or more of them.

Among anionic surfactants (D), preferred are anionic surfactants (Dn), derived from said nonionic surfactant (Bn) having a narrow molecular weight distribution (Mw/Mn ratio) satisfying the above inequality (I) or (II) [more preferably satisfying the inequality (IV) or (V)] and having a distribution constant (c) of 2.0 or less (especially 1.0 or less), for achieving better surface activity.

Anionic surfactants (Dn) are obtainable by anionizing the hydroxyl group of said nonionic surfactant (Bn) through any of known anionization methods. Suitable anionization methods include, for example, sulfation, phosphation, carboxyetheration (ethercarboxylation) and sulfocarboxylate esterification. Sulfation can be done using a sulfating agent, such as chlorosulfonic acid, sulfamic acid, sulfuric acid, fuming sulfuric acid, sulfuric anhydride or the like. Phosphation may be accomplished with a phosphating agent, such as phosphoric acid, polyphosphoric acid, phosphorus oxychloride or the like. Carboxyetheration may be carried out by using a caustic alkali (particularly sodium hydroxide) with a monohalofatty acid($C_{2-6}$), such as monochloroacetic, monobromoacetic, monochloropropionic or monobromopropionic acid or the like. Sulfocarboxylate esterifications include a method comprising the step of reacting (Bn) with maleic anhydride to obtain a monomaleate and the step of sulfonating the monomaleate with a sulfite or acid sulfite to produce a sulfosuccinate ester of (Bn); and a method by esterification of (Bn) with an α-sulfonated carboxylic acid ($C_{10-22}$), such as α-sulfopalmitic or α-sulfostearic acid or the like, to obtain an α-sulfocarboxylate.

Illustrative of suitable anionic surfactants (Dn) include sulfate esters, phosphate esters, carboxyalkyl ethers and sulfosuccinate esters, described in WO 00/18857 (PCT/JP99/05305) incorporated herein by reference.

Two or more of these sulfates, phosphates, carboxyalkyl ethers and sulfosuccinate esters can be used in combination, for instance, a sulfate and/or a carboxymethyl ethers with a sulfosuccinate ester.

Besides, there may also be used mixed phosphates or mixed sulfosuccinates of (Bn) with and another hydroxyl compound [such as saturated or unsaturated aliphatic alcohol($C_{1-18}$), (poly)oxyalkylene ether of lower aliphatic alcohols ($C_{1-6}$) having 1–30 oxyalkylene($C_{2-4}$) groups, or the like].

Exemplary of suitable amphoteric surfactants are amino acid type amphoteric surfactants, for example, those of alanine type, such as N-alkyl($C_{8-24}$)-β-amino-propionic acid salts and N-alkyl($C_{8-24}$)-β-iminodipropionic acid salts; those of glycine type, such as alkyl($C_{8-24}$)di(amino-ethyl) glycine salts and dialkyl($C_{8-24}$)diethylenetriamineacetic acid salts; betaine type amphoteric surfactants, for example, those of carboxy betaine type, such as N-alkyl ($C_{8-24}$) triglycines, dimethylalkyl($C_{8-24}$)betaines and alkyl ($C_{8-24}$) betaines; those of alkylimidazoline type, such as N-carboxymethyl-2-alkyl($C_{8-24}$)imidazoline betaines; and sulfonic acid salt type amphoteric surfactants, such as those of betain type, such as N-alkyl($C_{8-24}$)taurine salts.

Among these surfactants, preferred are nonionic surfactants (B), cationic surfactants (C) and combinations of them.

The liquid detergent composition may further contain a quaternary ammonium or organic amine salt (E) of a low molecular weight polycarboxylic acid and/or another quaternary ammonium or organic amine salt (F).

Said salt (E) is a quaternary ammonium or organic amine salt of a low molecular weight polycarboxylic acid having an Mn of lower than that of said carboxyl-containing polymer in (A) or (A').

Suitable low molecular weight polycarboxylic acids constituting (E) include, for example, aliphatic and aromatic polycarboxylic acids, which have an Mn of usually not more than 700 (preferably 150–500) and contain in the molecule usualy from two to eight (preferably 2–4) carboxyl groups with or without hydroxyl or amino group(s). Examples of suitable polycarboxylic acids include aliphatic and aromatic dicarboxylic acids, such as oxalic, malonic, succinic, glutaric, adipic, azelaic, sebacic, maleic, fumaric, itaconic, citraconic, mesaconic, phthalic, isophthalic and terephthalic acids; aliphatic and aromatic tricarboxylic acids, such as butanetricarboxylic, aconitic and trimellitic acids; aliphatic and aromatic hydroxypolycarboxylic acids, such as malic, citric, tartaric and carboxy methoxysuccinic acids; amino (primary, secondary or tertiary amino) group-containing polycarboxylic acids, such as ethylenediaminetetraacetic acid (EDTA), nitrilotriacetic acid (NTA), 1-hydroxyethyliminodiacetic acid (HEDA) and aspartic acid.

Among these acids, preferred are aliphatic hydroxypolycarboxylic acids and amino group-containing polycarboxylic acids, particularly citric acid and HEDA.

Suitable quaternary ammonium cations constituting (E) include the same ones of the general formula (1) as in said (A) and (A'). Among these quaternary ammonium cations, preferred are those having alkyl($C_{2-12}$) groups, particularly triethylmethyl, triethyloctyl and tetraethyl ammonium cations.

Suitable organic amines constituting (E) include the same ones (including aliphatic, alicyclic and heterocyclic amines and adducts of AO to these amines) as in said (A'). Among these amines, preferred are alkanolamines, especially TEA.

Quaternary ammonium salts and organic amine salts (E) of low molecular weight polycarboxylic acid can be prepared by any known methods, for example, in the same manner as in (A) or (A') described above.

The neutralization degree of carboxyl groups of low molecular weight polycarboxylic acid is usually 30 to 100%, preferably 60 to 100%, most preferably 80 to 100%.

Illustrative of suitable salts (E) are TEA salts and monoethanolamine salts of citric acid, maleic acid, malonic acid, EDTA and HEDA; and triethylmethylammonium citrate. Among these, preferred are TEA salts of citric acid, maleic acid and HEDA, particularly TEA citrates, especially tri (TEA) citrate.

Said salt (F) is a quaternary ammonium or organic amine salt other than said (A'), (C) and (E).

Suitable quaternary ammonium or organic amine salts (F) include ones free from any long chain aliphatic hydrocarbon moiety containing 7 or more carbon atoms, for example, those represented by the general formula (9) or (10):

(9)

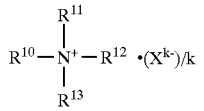

(10)

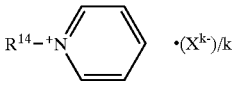

In the formula (9), $R^{10}$ is an organic group, selected from the group consisting of aliphatic hydrocarbyl, acyloxyalkyl, acylaminoalkyl, alkoxyalkyl and hydroxyalkyl groups, containing 1–6 carbon atoms in the aliphatic hydrocarbon moiety thereof. $R^{11}$ and $R^{12}$ are independently selected from the group consisting of hydrogen atom, aliphatic hydrocarbyl($C_{1-6}$) groups, hydroxyalkyl($C_{2-6}$ preferably $C_{2-4}$) groups and polyoxyalkylene groups represented by the formula: —($A^1$O)n-Z, wherein $A^1$ is an alkylene group containing 2–4 carbon atoms, Z is a hydrogen atom or an acyl group containing 1–7 carbon atoms (preferably 1–4 carbon atoms) and n is an integer of 2–50 (preferably 5–30); preferably selected from the group consisting of alkyl($C_{1-4}$) and benzyl groups. $R^{11}$ and $R^{12}$ may be joined to form, together with the quaternary nitrogen atom, a heterocyclic ring [five- or six-membered monocyclic or bicyclic rings, such as morpholine, piperidine, pyrrolidine and 1,8-diazabicyclo(5,4,0)-7-undecene rings]. $R^{13}$ is selected from the group consisting of hydrogen atom, aliphatic hydrocarbyl($C_{1-6}$) groups, benzyl group, hydroxyalkyl($C_{2-6}$ preferably $C_{2-4}$) groups and polyoxyalkylene groups of the formula: —($A^1$O)n-Z, wherein $A^1$, Z and n are as previously defined. In the formula (10), $R^{14}$ is an organic group, selected from the group consisting of aliphatic hydrocarbyl, β-hydroxyalkyl, acyloxymethyl and alkoxymethyl groups, containing 1–6 carbon atoms in the aliphatic hydrocarbon moiety thereof. In the formulae (9) and (10), X is an anionic counter ion, having a valency of k, other than polycarboxylate ion; and k is an integer of 1–3 (preferably 1).

Examples of suitable aliphatic hydrocarbyl groups of $R^{10}$, $R^{11}$, $R^{12}$, $R^{13}$ and $R^{14}$ include the same ones as mentioned in examples of $R^1$, $R^2$, $R^3$ and $R^4$. Suitable acyloxyalkyl and acylaminoalkyl groups of $R^{10}$ include, for example, those having a fatty acyl($C_{1-7}$) group and alkylene($C_{2-6}$) group (e.g. ethylene, propylene and butylene groups), such as acetyloxyethyl, butyryloxyethyl, acetylamidoethyl and acetylamidopropyl groups. Exemplary of suitable alkoxyalkyl groups of $R^{10}$ are those having an alkoxy($C_{1-6}$) group and alkylene($C_{2-6}$)group, such as methoxyethyl and propoxyethyl groups. Suitable hydroxyalkyl groups of $R^{10}$, $R^{11}$, $R^{12}$, $R^{13}$ and $R^{14}$ are inclusive of β-hydroxyalkyl groups, such as hydroxyethyl, hydroxy-propyl, hydroxybutyl and hydroxyhexl groups. Examples of suitable polyoxyalkylene groups of the formula: —($A^1$O)n-Z are polyoxyethylene groups of the formula: —($CH_2CH_2O$)n-H and lower fatty esters (such as acetate, propionate and butyrate) thereof. Illustrative of suitable acyloxymethyl and alkoxymethyl groups of $R^{14}$ are methoxymethyl, ethoxymethyl and acetoxymethyl groups. Suitable anionic counter ions of X include inorganic ones, for example, halide ions (such as fluoride, chloride, bromide and iodite ions), hydroxyl, nitrate, sulfate, phosphate and carbonate ions; and organic ones, for instance, monocarboxylate ions ($C_{1-7}$ preferably $C_{1-4}$), such as formate, acetate, propionate, butyrate, isobutyrate, valerate, iso-valerate and pivalate ions, and hydroxymonocarboxylate ions, such as glycolate, lactate, gluconate and salicylate ions; alkyl($C_{1-6}$ preferably $C_{1-4}$) sulfate ions, such as methosulfate and ethosulfate ions; alkyl($C_{1-6}$ preferably $C_{1-4}$) carbonate ions, such as methyl carbonate and ethyl carbonate ions; alkyl ($C_{1-6}$ preferably $C_{1-4}$) phosphate ions, such as mono- and/or di- methyl phosphate and ethyl phosphate ions; alkane or alkene($C_{1-6}$ preferably $C_{1-4}$)sulfonate and alkyl($C_{1-6}$ preferably $C_{1-4}$) benzenesulfonate ions, such as methanesulfonate, ethanesulfonate and p-toluenesulfonate ions.

Illustrative examples of suitable salts (F) are salts of lower amines (primary, secondary and tertiary aliphatic amines, such as triethylamine, ethyldimethylamine, N-methylhexamethylene imine, and N,N,N',N'-tetramethylethylenediamine; heterocyclic non-aromatic and aromatic amines, such as N-methylpyrrolidine, N-methylpiperidine, N-methylmorpholine, 1,8-diazabicyclo(5,4,0)-7-undecene, 4-dimethylaminopyridine, N-methylimidazole and 4,4'-dipyridyl) with an acid of the formula $H_kX$ (inorganic acids, such as hydrochloric and phosphoric acids; and organic acids, such as acetic, succinic and lactic acids); tetraalkyl($C_{1-6}$) ammonium salts, such as tetraethylammonium ethosulfate; (hydroxy)alkyl($C_{1-6}$) pyridinium salts, such as ethylpyridinium chloride and hydroxyethylpyridinium bromide. Among these, preferred are quaternary ammonium salts, particularly tetraethylammonium ethosulfate and ethylpyridinium chloride.

Quaternary ammonium salts and organic amine salts (F) can be prepared by any known methods, for example, in the same manner as (C).

The liquid detergent composition may further contain at least one other detergent builder. Examples of such builders include inorganic builders, including alkali builders, such as sodium hydroxide, soda ash, ammonia, TEA, ammonium and alkali metal (e.g. sodium) polyphosphates (e.g. tripolyphosphate), phosphonates, carbonates, bicarbonates, silicates, aluminosilicates and sulfate; and organic builders, such as alkali metal nitrilotriacetates, citrates, oxydisuccinates and carboxylmethoxysuccinates, and alkali metal, ammonium and amine salts of carboxyl-containing polymers (as mentioned above, such as polyacrylic acids).

In the liquid detergent composition comprising a surfactant and a builder, in an aspect of this invention, said quaternary ammonium salt (A) constitutes an essential component of the builder. In view of compatibility of the builder with the surfactant and stability of the composition, (A) is to be contained in an amount of at least 30%, and, correspondently, said other detergent builder may be used in an amount not larger than 70%, based on the weight of the builder. [In the above and hereinafter, "%" represents "% by weight", unless otherwise specified.] It is preferred to use (A) in an amount of at least 50%, particularly at least 70%, most preferably 90% to 100%, based on the weight of the builder.

In the liquid detergent composition of the invention, the contents of the surfactant and the builder comprising (A) can vary over a wide range, as far as providing a detergent composition liquid at room temperature. In general, (A) is contained in an amount of 1–30%, based on the whole weight of the composition. (A) is used preferably in an amount of 2–20%, more preferably 3–15%, most preferably 5–10% for the purpose of providing better detergency; while it may be preferred to use (A) in such a lower amount as 1–3% particularly 2% for lower cost. Said other builder is preferably used in an amount of 0–10%, particularly 0–5%, based on the whole weight of the composition.

The surfactant is used in an amount of usually 1–95%, preferably 10–80%, more preferably 20–70%, most preferably 30–60%.

In a preferred embodiment of this invention, the surfactant comprises a nonionic surfactant (B). (B) is used in an amount of usually 10–80%, preferably 20–75%, more preferably 30–60%. (B) is preferably comprised mainly of (B1) of the formula (2) [especially (Bn) of narrow molecular weight distribution and low distribution constant], particularly at least 85% of (B1) [especially (Bn)].

In combination with or in place of (B), there can be used a cationic surfactant (C). (C) is usually contained in an amount of up to 10%, preferably not more than 5%, based on the detergent composition. In combination with or in place of (B), there may be used an anionic surfactant and/or an amphoteric surfactant, in an amount of generally 0–15%, preferably 0–10%, based on the detergent composition. It is preferred to use (C) without using any anionic surfactant. In case where (C) and an anionic surfactant (D) are used together, it is desirable to avoid using them in the neiborhood of the equivalent amount (for instance, at an equivalent ratio in the range of 1/1.2–1.2/1, particularly 1/1.1–1.1/1). That is, one of (C) and (D) is to be used in an amount more than 10% in excess, preferably more than 20% in excess.

Water is contained usually in an amount of not larger than 98%, preferably 2–80%, more preferably 10–60%, most preferably 30–50%.

The liquid detergent composition comprising the surfactant and the builder comprising (A) may further contain a quaternary ammonium or organic amine salt (E) of a low molecular weight polycarboxylic acid and/or another quaternary ammonium or organic amine salt (F). (E) is usually used in an amount of up to 20%, preferably not more than 15%, and (F) is used in an amount of up to 10%, preferably not more than 5%, based on the whole weight of the detergent composition.

The total amount of (A), (B), (C), (E), (F) and water in the liquid detergent composition is preferably at least 50%, more preferably at least 60%, most preferably at least 80%.

In another aspect of the present invention, said nonionic surfactant (Bn) and/or said anionic surfactant (Dn) derived therefrom is used in combination with one or more of said quaternary ammonium salt (A) or organic amine salt (A') of carboxyl group-containing polymer, said cationic surfactant (C), said salt (E) and said salt (F).

The contents of these components can vary over a wide range, and may be in such amounts as follows, based on the whole weight of the detergent composition.

(Bn) and/or (Dn) is contained in an amount of usually 1–95%, preferably 10–80%, more preferably 20–60%, most preferably 30–50%. In case of using (Bn) together with another nonionic surfactant, it is preferred to use (Bn) in a major amount, particularly in an amount of at least 85% of the whole nonionic surfactants (B). In case of using (Dn) together with another anionic surfactant, it is preferred to use (Dn) in a major amount, particularly in an amount of at least 85% of the whole anionic surfactants (D).

(A) or (A') is contained in an amount of generally 1–30%, preferably in an amount of 2–20%, more preferably 3–15%, most preferably 5–10% for the purpose of providing better detergency; while it may be preferred to use (A') in such a lower amount as 1–3% particularly 2% for lower cost.

In general, (Bn) and/or (Dn) can be used together with 0.01–10% (preferably 0.05–5%) of [(C) and/or (F)] and/or 0.1–20% (preferably 1–15%) of (E). An amphoteric surfactant may be used in an amount of usually 0–15%, preferably 0–5%.

(Bn) may be used together with up to usually 15%, preferably up to 5% of (D) and/or an amphoteric surfactant.

It case of using (C), it is preferred to use without using anionic surfactant. That is, (Dn) [or a combination thereof with (Bn)] is preferably used together with (A) or (A'), (F) and/or (E), particularly with (A) or (A') and/or (E). In case where (C) and (Dn) are used together, it is desirable to avoid using them in the neiborhood of the equivalent amount (for instance, at an equivalent ratio in the range of 1/1.2–1.2/1, particularly 1/1.1–1.1/1).

The total amount of the surfactants is not more than 95%, preferably not more than 80%.

Water may be contained in an amount of usually not larger than 98%, preferably 2–80%, more preferably 10–60%, most preferably 30–50%.

The total amount of (B) and/or (D) [including (Bn) and/or (Dn)], (A) or (A'), (C), (E), (F) and water in the detergent composition is preferably at least 50%, more preferably at least 60%, most preferably at least 80%.

The liquid detergent composition comprising the surfactant and the builder comprising (A) and the detergent composition comprising (Bn) and/or (Dn) together with one or more of (A) or (A'), (C), (E) and (F), according to the present invention, may further contain one or more other ingredients.

Other ingredients optionally used, include, one or more additives, for example, fluorescents [such as bis(triazinyl) styrbenzenesulfonic acid derivatives], bleaching agents (ones of hypohalite bleach type, such as trichloro isocyanuric acid, sodium and potassium dichloroisocyanurates, and N-chloro and N-bromo alkane sulfonamides; and oxygen-containing bleaches, such as sodium perborate, sodium percarbonate and potassium non-opersulfate), softening agents (such as imidazolinium type cationic surfactants), enzymes (such as proteases and glucosidases, for removal of protein-based or carbohydrate-based stains), bactericides (such as benzoic, dehydroacetic and sorbic acids), perfumes and colorants (such as dyes and pigments). There may be optionally used, as a diluent, one or more hydrophilic solvents, for example, lower monohydric and polyhydric alcohols, such as methanol, ethanol, isopropyl alcohol, ethylene glycol and propylene glycol). Besides, one or more antifoamers (for example, silicone-based antifoamers; polyoxyalkylene-based antifoamers, such as polyoxypropylene ethers and hydrophobic Pluronics; and mineral oil-based antifoamers. These optional ingredients can be used generally in such amounts of 0–5% of the above additive(s), 0–20% of the diluent(s) and 0–5% of the antifoamer(s), based on the whole weight of the detergent composition.

Detergent compositions of the present invention are especially useful for washing textile materials, including woven fabrics and knits, of natural fibers (such as cotton, hemp and wool), chemical fibers (regenerated cellulose fibers, such as rayon and acetate fibers) and synthetic fibers (such as polyester, polyamide, acrylic and spandex fibers); and fiber blends, textile blends, mixed or union fabrics of two or more these fibers, for example, those made of cotton or hemp with other fiber(s) (such as wool, polyester, polyamide or/and acrylic fibers); those of wool with other fiber(s) (such as polyester, polyamide or/and acrylic fibers), those of polyester fiber with other fiber(s) (such as rayon, acetate, polyamide, acrylic or/and spandex fibers), those of polyamide fiber with other fiber(s) (such as rayon, acetate, acrylic or/and spandex fibers).

Detergent compositions of this invention can be dissloved into water to make up a cleaning liquor, usually having a solid concentration [a concentration of active ingredients: the total of the builder and the surfactant and optionally (E) and/or (F)], ranging from 0.001 g/L to 5 g/L, preferably 0.1 g/L to 2 g/L.

Washing of clothes may be carried out at a bath ratio (clothe/liquor ratio) not particularly limited, preferably 1:4 to 1:40, more preferably 1:6 to 1:30, most preferably 1:8 to 1:25.

Clothes can be washed at a temperature optionally selected depending upon the kind of the fibrous material thereof, usually at a temperature of 5–80° C., preferably 20–50° C.

Detergent compositions of the invention are useful not only for washing clothes but also for industrial uses, such as scouring and soaping of textile materials.

Detergent compositions of the invention can be applied for washing in various manners. Household detergents may be applied through hand washing or with a washer. For industrial use, there can be used batch treatment using a jet dyeing machine, continuous treatment using a continuous scouring machine and the like.

Detergent compositions of the present invention are suitable for washing with washers capable of providing less damage to laundry, particularly a centrifugal washer. The centrifugal washer has a washing system of washing off dirt by passing water through the laundry with centrifugal force generated by rotation of a washing machine tub. Suitable centrifugal washers are described in JP Pat.No.3,022,490 (JP Pat.Lay-open No.347,283/1999), incorporated herein by reference, and include, for example, centrifugal washers "NA-800P" manufactured by Matsushita Electric Industrial Co., Ltd.

BEST MODE FOR CARRYING OUT THE INVENTION

Having generally described the invention, a more complete understanding can be obtained by reference to certain specific examples, which are included for purposes of illustration only and not intended to be limiting unless otherwise specified.

Measurements of Molecular Weights and Alcohol Content

In this specification, measurements of molecular weights of carboxyl group-containing polymers and nonionic surfactants and content of unreacted aliphatic alcohols in the nonionic surfactants are carried out under the following procedures and conditions.

1) Molecular weights of carboxyl group-containing polymer are measured through GPC under the following conditions:

Machine: Waters 510, manufactured by Japan Waters Ltd.; Column: TSK gels G5000pwXL and G3000pwXL, produced by Tosoh Corp.; Column temperature: 40° C.; Detector: RI; Solvent: 0.5% solution of sodium acetate in water/methanol (volume ratio: 70/30); Flow rate: 1.0 ml/min.; Sample concentration: 0.25%; Injection volume: 200 μl; Standard: polyoxyethylene glycol, TSK STANDARD POLYETHYLENE OXIDE, produced by Tosoh Corp.; and Data processor: SC-8010, produced by Tosoh Corp.

2) Molecular weights of nonionic surfactant are measured through GPC under the following conditions:

Machine: HLC-8120, produced by Tosoh Corp., Column: TSK gels SuperH4000, SuperH3000 and SuperH2000, produced by Tosoh Corp.; Column temperature: 40° C.; Detector: RI; Solvent: tetrahydrofuran; Flow rate: 0.6 ml/min.; Sample concentration: 0.25%; Injection volume: 10 μl; Standard: polyoxyethylene glycol, TSK STANDARD POLYETHYLENE OXIDE, produced by Tosoh Corp.; and Data processor: SC-8020, produced by Tosoh Corp.

3) Contents of unreacted aliphatic alcohols in nonionic surfactant are measured through GC under the following conditions:

Machine: Gas chromatograph GC-14B, produced by Shimadzu Corp.; Detector: FID; Column: Glass column (inner diameter: about 3 mm, length: about 2 m); Column packing material: Silicone GE SE-30 5%; Column temperature: raised from 90° C. to 280° C., at a heat-up rate of 4° C./min.; Carrier gas: nitrogen; Sample: 50% acetone solution; Injection volume: 1 μl; Determination: determined using, as an internal standard, an aliphatic alcohol containing carbon atoms less by 2 or 3 than the aliphatic alcohol to be measured.

Performance Testing

In this specification, evaluations of detergency, foam behavior and stability of detergent compositions are carried out using the following procedures.

a) Detergency Testing

This is carried out in a centrifugal washer, NA-800P produced by Matsushita Electric Industrial Co., Ltd. The procedure involves washing a synthetic soiled cloth (a knitted cotton) for 10 minutes with 50 L of water at 25° C. using 25 g of a detergent at a cloth/liquor ratio of 1:30. The wash is followed by twice rinse cycle of 3 minutes. Reflectances at 540 nm of the washed cloth, the soiled cloth and an unsoiled cloth are determined with a multi-light source spectrophotometric calorimeter procuded by Suga Test Instruments; and detergency is calculated according to the following equation:

$$\text{Detergency } (\%)=100\times(R_W-R_S)/(R_I-R_S)$$

wherein $R_I$, $R_W$ and $R_S$ is reflectances of the washed cloth, the soiled cloth and the unsoiled cloth, respectively.

The synthetic soiled cloth used in the testing is a wet synthetic soiled cloth, available from the Society of Laundry Science, having a reflectance at 540 nm of 40±5% and have been soiled with a composition containing 28.3% of oleic acid, 15.6% of triolein, 12.2% of cholesterol oleate, 2.5% of liquid paraffin, 2.5% of squalene, 1.6% of cholesterol, 7.0% of gelatin, 29.8% of mud and 0.5% of carbon black. The evaluation criterion is as follows:

◎: detergency of 40% or more,

○: detergency of 32% or more and less than 40%,

Δ: detergency of 20% or more and less than 32%,

×: detergency of 20% or less.

b) Foam Behavior Testing

Evaluation of foam behavior (low foaming properties) of 1.5 L of a 0.1% aqueous solution of a detergent is carried out using a jet foam examination apparatus of high pressure injection type, produced by Tsujii Dyeing Machine Industry. The evaluation criterion is as follows:

○: foam height of 20 mm or less,

Δ: foam height of 20–50 mm,

×: foam height of 50 mm or more.

c) Stability

Stability is tested through visually observing the appearance of a detergent composition after having been allowed to stand for 24 hours at 25° C., and evaluated the following criterion.

○: no separation being observed,

×: separation being observed.

Nonionic Surfactants (B)

Nonionic surfactants used in Examples and Comparative Examples are of as shown in Table 1.

TABLE 1

| | Structure | Mw/Mn | Calc.* | (c) |
|---|---|---|---|---|
| (Bn1) | $C_8H_{17}(EO)_{12}H$ | 1.045 | 1.074 | 0.89 |
| (Bn2) | $C_{12}H_{25}(EO)_9H$ | 1.062 | 1.076 | 0.92 |
| (Bn3) | $C_{18}H_{35}(EO)_{10}H$ | 1.068 | 1.079 | 0.87 |
| (Bn4) | $C_8H_{17}(EO)_9(PO)_3H$ | 1.023 | 1.074 | 0.92 |
| (Bn5) | $C_{12}H_{25}(EO)_9(PO)_3H$ | 1.021 | 1.074 | 0.91 |
| (Bn6) | $C_{18}H_{35}(EO)_9(PO)_3H$ | 1.068 | 1.074 | 0.91 |
| (Bn7) | $C_8H_{17}(EO)_4(PO)_2(EO)_8H$ | 1.067 | 1.070 | 0.82 |

TABLE 1-continued

| | Structure | Mw/Mn | Calc.* | (c) |
|---|---|---|---|---|
| (Bn8) | $C_{13}H_{27}(EO)_4(PO)_2(EO)_8H$ | 1.059 | 1.070 | 0.88 |
| (Bn9) | $C_{18}H_{35}(EO)_4(PO)_2(EO)_8H$ | 1.063 | 1.070 | 0.91 |
| (Bn10) | $C_{13}H_{27}(EO)_1(PO)_1(EO)_{10}H$ | 1.052 | 1.074 | 0.48 |
| (Bn11) | $C_{13}H_{27}(EO)_8(PO)_2(EO)_3H$ | 1.054 | 1.072 | 0.65 |
| (Bn12) | $C_{10}H_{21}[(EO)_7/(PO)_2](EO)_2H$ | 1.062 | 1.074 | 0.68 |
| (Bn13) | $C_{10}H_{21}[(EO)_8/(PO)_2](EO)_5H$ | 1.058 | 1.069 | 0.77 |
| (Bn14) | $C_{18}H_{35}[(EO)_8/(PO)_2](EO)_7H$ | 1.047 | 1.065 | 0.78 |
| (Bn15) | $C_{13}H_{27}[(EO)_4/(PO)_2](EO)_8H$ | 1.045 | 1.070 | 0.77 |
| (Bn16) | $C_{13}H_{27}[(EO)_{10}/(PO)_2](EO)_{38}H$ | 1.052 | 1.060 | 0.60 |
| (Bn17) | $C_{13}H_{27}[(EO)_2/(PO)_4](EO)_{15}(PO)_{12}H$ | 1.045 | 1.048 | 0.53 |
| (Bn18) | $C_{13}H_{27}[(EO)_8/(PO)_2](EO)_{10}(PO)_4H$ | 1.045 | 1.048 | 0.68 |
| (Bn19) | $C_{18}H_{35}[(EO)_2/(PO)_4](EO)_{10}(PO)_1H$ | 1.063 | 1.065 | 0.72 |
| (Bn20) | $C_{18}H_{35}[(EO)_8/(PO)_4](EO)_{10}(PO)_8H$ | 1.048 | 1.051 | 0.65 |
| (Bn21) | $C_{12}H_{25}(EO)_2H$ | 1.020 | 1.031 | 0.52 |
| (Bw1) | $C_{12}H_{25}(EO)_9H$ | 1.221 | 1.076 | 3.26 |
| (Bw2) | $C_{12}H_{25}(EO)_9(PO)_3H$ | 1.089 | 1.074 | 3.09 |
| (Bw3) | $C_{13}H_{27}(EO)_4(PO)_2(EO)_8H$ | 1.210 | 1.070 | 3.02 |
| (Bw4) | $C_{12}H_{25}(EO)_2H$ | 1.070 | 1.031 | 7.59 |
| (Bi) | Sorbitan monolaurate $(EO)_4$ | — | — | — |
| (Bii) | Lauric acid monomethanolamide | — | — | — |

(Note) *: The right side of the inequality (I) or (II).

Among these, nonionic surfactants (Bn1) to (Bn21), satisfying the inequality (I) or (II) and having a distribution constant (c) of 2.0 or less, were produced, in accordance with WO 00/18857, by adding about 2 moles of an AO to an aliphatic alcohol in the presence of magnesium perchlorate, followed by further adding an AO in the presence of potassium hydroxide; and nonionic surfactants (Bw1) to (Bw4), having a distribution constant (c) of higher than 2.0, were produced using potassium hydroxide as the catalyst.

Surfactants (C) and (D), and Salts (E) and (F)

Cationic surfactants (C), anionic surfactants (D), salts (E) of low molecular weight polycarboxylic acid and salts (F) with no long-chain aliphatic hydrocarbon moiety used in Examples and Comparative Examples are as follows:

(C1): hydrochloride of stearylmethylamine, prepared by reacting methyl chloride with stearylamine.

(C2): stearyltrimethylammonium methyl carbonate, prepared by reacting dimethyl carbonate with stearyldimethylamine.

(C3): octylpyridinium chloride, prepared by reacting octyl chloride with pyridine.

(C4): capryloyloxyethyldihydroxyethylammonium methyl carbonate, prepared by reacting dimethyl carbonate with capryloyloxyethyldihydroxyethylamine prepared by reacting caprylic acid with TEA.

(C5): dilauryldimethylammonium chloride, prepared by reacting methyl chloride with dilaurylmethylamine.

(C6): stearamidoethyldiethylmethylammonium methosulfate, prepared by reacting dimethylsulfate with stearamidoethyldiethylamine prepared by reacting N,N-diethylethylenediamine with stearic acid.

(Dn1): Sodium sulfate of (Bn21) (70% aqueous solution), produced by adding 120 parts (1.03 mole) of chlorosulfonic acid dropwise to 274 parts of (Bn21) having been prepared by reacting 88 parts (2 moles) of EO to 186 parts (1 mole) of lauryl alcohol in the presence of 0.32 parts of magnesium perchlorate and 0.03 parts of magnesium hydroxide, followed by neutralizing the resulting sulfate ester with an aqueous solution 41.2 parts (1.03 mole) of sodium hydroxide dissolved in 102 parts of water.

(Dw1): Sodium sulfate of (Bw4), produced in the same manner as (Dn1), except using (Bw4) instead of (Bn21).

DBS: Sodium dodecylbenzenesulfonate.

(E1): TEA citrate.

(E2): triethylmethylammonium citrate.

(E3): octyltrimethylammonium citrate.

(F1): tetraethylammonium ethosulfate, prepared by reacting diethyl sulfate with triethylamine.

(F2): ethylpyridinium chloride, prepared by reacting ethyl chloride with pyridine.

Polymers

Polymers used in Comparative Examples are as follows:

PVA: polyvinyl alcohol having an Mw of 22,000 (PVA-105, produced by Kuraray Co.,Ltd., PSS: Sodium polystyrenesulfonate having an Mw of about 40,000 (Chemistat SA-9, produced by Sanyo Chemical Industries.).

Production of Carboxyl-containing Polymers

EXAMPLE I

Into a pressure reaction vessel, were charged 420 parts of iso-propyl alcohol and 120 parts of water. After replacing the atmosphere within the vessel with nitrogen, the vessel was sealed and the temperature was raised to 100° C. Under stirring, were dropped separately 77 parts of acrylic acid over 3 hours, a homogeneous mixture of 228 parts of acrylic acid, 4 parts of a chain-transfer agent (triethylene glycol dimercaptan), 2 parts of sodium hypophosphite dihydrate and 0.7 parts of ferrous chloride tetrahydrate over 2 hours, and 50 parts of a 6% aqueous solution of sodium persulfate over 3.5 hours. (Dropping was commenced at the same time.) After completion of dropping, 3 parts of a 35% aqueous solution of hydrogen peroxide was charged. The resulting mixture was stirred for 1 hour at 100° C. to provide an aqueous solution of a polymer (a1) having an Mw of 10,000 and an Mn of 7,800, with a polymerization rate of 99.9%.

EXAMPLE II

Into a pressure reaction vessel, were charged 370 parts of iso-propyl alcohol and 170 parts of water. After replacing the atmosphere within the vessel with nitrogen, the vessel was sealed and the temperature was raised to 100° C. Under stirring, 264.9 parts of acrylic acid, 40.1 parts of AMPS and 80 parts of a 4% aqueous solution of sodium persulfate were dropped separately over 3 hours, respectively. (Dropping was commenced at the same time.) After completion of dropping, 3 parts of a 35% aqueous solution of hydrogen peroxide was charged. The resulting mixture was stirred at 100° C. for 1 hour to provide an aqueous solution of a polymer (a2) having an Mw of 8,000 and an Mn of 5,600, with a polymerization rate of 99.9%.

Production of Salts of Carboxyl-containing Polymers

EXAMPLE III (1) Into a pressure vessel, were charged 195 parts of methanol and 276 parts of dimethyl carbonate. After replacing the atmosphere within the vessel with nitrogen, the vessel was sealed and the temperature was raised to 120° C. Under stirring was dropped 219 parts of triethylamine, followed by continuing stirring for 2 hours at 120° C. to obtain a methanol solution containing unreacted dimethyl carbonate and triethylmethylammonium methylcarbonate (b1) in an amount of 60%.

(2) After mixing 690 parts of the methanol solution of (b) thus obtained with 400 parts of the aqueous solution of the polymer (a1) to anion exchange 100% of the carboxyl groups thereof; iso-propyl alcohol, methanol and unreacted dimethyl carbonate were distilled off at 100° C. under normal pressures. Subsequently, 580 parts of water was added thereto to obtain a 45% aqueous solution of a quaternary ammonium salt (A1) of polyacrylic acid.

EXAMPLES IV AND V

Aqueous solutions of quaternary ammonium salts (A2) and (A3) of polyacrylic acid were produced by repeating Example III except that the amount of the aqueous solution of the polymer (a1) was varied so as to anion exchange 85% and 60% of the carboxyl groups, respectively.

EXAMPLES VI AND VII

Aqueous solutions of quaternary ammonium salts (A4) and (A5) of polyacrylic acid were produced by repeating Example III except using octyldimethylamine and decyldimetylamine, respectively, instead of triethylamine.

EXAMPLE VIII

After mixing 707 parts of the same methanol solution of (b) as in Example III with 519 parts of the aqueous solution of the polymer (a2) to anion exchange 100% of the carboxyl groups thereof; iso-propyl alcohol, methanol and unreacted dimethyl carbonate were distilled off at 100° C. under normal pressures to obtain an aqueous solution of a quaternary ammonium salt (A6) of acrylic acid/AMPS copolymer.

EXAMPLE IX (1) An aqueous solution of triethylmethylammonium acrylate was prepared by neutraluzing 303 parts of a 39% aqueous solution of acrylic acid with 373 the same methanol solution of (b) as in Example III.

(2) Into a pressure vessel, was charged 690 parts of water, followed by replacing the atmosphere within the vessel with nitrogen, sealing the vessel and then raising the temperature to 90° C. Under stirring, 575 parts of the aqueous solution of triethylmethylammonium acrylate and 232 parts of an aqueous solution containing 8 parts of sodium persulfate were dropped separately over 4 hours, followed by continuing stirring for an hour at 90° C. to obtain an aqueous solution of a polymer (a3), comprised of partial quaternary ammonium salt of acrylic acid having a neutralization degree of about 70%, the polymer (a3) having an Mw of 5,700 and an Mn of 5,000.

(3) After mixing 90 parts of the same methanol solution of (b) as in Example III with 1485 parts of the aqueous solution of the polymer (a3) to further anion exchange of the residual free carboxyl groups thereof; iso-propyl alcohol, methanol and unreacted dimethyl carbonate were distilled off at 100° C. under normal pressures to obtain a 30% aqueous solution of a quaternary ammonium salt (A7) of polyacrylic acid having a neutralization degree of 88%.

EXAMPLE X

A tertiary amine salt (A'1) of polyacrylic acid was prepared by neutralizing the aqueous solution of the polymer (a1) with hexyldimethylamine to 100% neutralization degree.

COMPARATIVE EXAMPLE I

An ammonium salt (A'1) of polyacrylic acid was prepared by neutralizing the aqueous solution of the polymer (a1) with an aqueous ammonia to 100% neutralization degree.

COMPARATIVE EXAMPLE II

A sodium salt (A'2) of polyacrylic acid was prepared by neutralizing the polymer (a1) with an aqueous solution of sodium hydroxide to 100% neutralization degree.

Cations, neutralization degrees and SP values of polymers thus prepared are as shown in Table 2.

TABLE 2

| | Polymer | Base polymer | Cation | Neutralization degree | SP value |
|---|---|---|---|---|---|
| Example III | (A1) | (a1) | Triethylmethylammonium | 100% | 8.7 |
| Example IV | (A2) | (a1) | Triethylmethylammonium | 85% | 9.4 |
| Example V | (A3) | (a1) | Triethylmethylammonium | 60% | 10.8 |
| Example VI | (A4) | (a1) | Octyltrimethylammonium | 100% | 8.6 |
| Example VII | (A5) | (a1) | Decyltrimethylammonium | 100% | 8.6 |
| Example VIII | (A6) | (a2) | Triethylmethylammonium | 100% | 8.7 |
| Example IX | (A7) | (a3) | Triethylmethylammonium | 88% | 9.3 |
| Example X | (A' 1) | (a1) | Hexyldimethylamine salt | 100% | 9.4 |
| Comparative Example I | (A' 1) | (a1) | Ammonium salt | 100% | 17.4 |
| Comparative Example II | (A' 2) | (a1) | Sodium salt | 160% | 14.3 |

Detergent Compositions

EXAMPLES 1–20

Detergent compositions were prepared by blending 6 parts of (E1), 5 parts of propylene glycol, 0.4 part of Alcalase 2.5 L (protease produced by Novo-Nordisk A/S) and 48.6 parts of water with each polymer (A) or (A') and nonionic surfactant (B) shown in Table 3; and detergency, foam behavior and stability were evaluated.

The results are as shown in Table 3.

TABLE 3

| Example No. | Polymer kind | Polymer parts | (B) kind | (B) parts | Detergency | Foam behavior | Stability |
|---|---|---|---|---|---|---|---|
| 1 | (A1) | 2 | (Bn1) | 38 | ◎ | Δ | ○ |
| 2 | (A1) | 5 | (Bn2) | 35 | ◎ | Δ | ○ |
| 3 | (A1) | 10 | (Bn3) | 30 | ◎ | Δ | ○ |
| 4 | (A2) | 10 | (Bn4) | 30 | ◎ | ○ | ○ |
| 5 | (A3) | 10 | (Bn5) | 30 | ◎ | ○ | ○ |
| 6 | (A4) | 10 | (Bn6) | 30 | ◎ | ○ | ○ |
| 7 | (A5) | 5 | (Bn7) | 35 | ◎ | ○ | ○ |
| 8 | (A7) | 2 | (Bn8) | 38 | ◎ | ○ | ○ |
| 9 | (A1) | 5 | (Bn9) | 35 | ○ | ○ | ○ |
| 10 | (A1) | 5 | (Bn10) | 35 | ○ | ○ | ○ |
| 11 | (A1) | 5 | (Bn11) | 35 | ○ | ○ | ○ |
| 12 | (A1) | 5 | (Bn12) | 35 | ◎ | ○ | ○ |
| 13 | (A1) | 5 | (Bn13) | 35 | ◎ | ○ | ○ |
| 14 | (A1) | 5 | (Bn14) | 35 | ○ | ○ | ○ |
| 15 | (A1) | 5 | (Bn15) | 35 | ○ | ○ | ○ |
| 16 | (A1) | 5 | (Bn16) | 35 | ◎ | ○ | ○ |
| 17 | (A1) | 5 | (Bn17) | 35 | ○ | ○ | ○ |
| 18 | (A1) | 5 | (Bn18) | 35 | ◎ | ○ | ○ |
| 19 | (A1) | 5 | (Bn19) | 35 | ◎ | ○ | ○ |
| 20 | (A1) | 5 | (Bn20) | 35 | ◎ | ○ | ○ |
| 21 | (A'1) | 5 | (Bn8) | 35 | ◎ | ○ | ○ |

EXAMPLES 22–31

Detergent compositions were prepared by blending 6 parts of (E) shown in Table 4, 5 parts of propylene glycol, 0.4 part of Alcalase 2.5 L and 48.6 parts of water with each polymer (A) and nonionic surfactant (B) shown in Table 4; and detergency, foam behavior and stability were evaluated.

The results are as shown in Table 4.

TABLE 4

| Example No. | Polymer kind | Polymer parts | (B) kind | (B) parts | (E) kind | Detergency | Foam behavior | Stability |
|---|---|---|---|---|---|---|---|---|
| 22 | (A1) | 1 | (Bn20) | 39 | (E1) | ◎ | ○ | ○ |
| 23 | (A1) | 5 | (Bn20) | 60 | (E1) | ◎ | ○ | ○ |
| 24 | (A1) | 15 | (Bn20) | 25 | (E1) | ◎ | ○ | ○ |
| 25 | (A1) | 5 | (Bn20) | 35 | (E1) | ◎ | ○ | ○ |
| 26 | (A1) | 2 | (Bn20) | 38 | (E2) | ◎ | ○ | ○ |
| 27 | (A3) | 5 | (Bw1) | 35 | (E2) | ○ | Δ | ○ |
| 28 | (A4) | 10 | (Bw2) | 30 | (E2) | ○ | ○ | ○ |
| 29 | (A5) | 10 | (Bw3) | 30 | (E3) | ○ | ○ | ○ |
| 30 | (A5) | 5 | (Bi) | 35 | (E3) | ○ | Δ | ○ |
| 31 | (A5) | 5 | (Bii) | 35 | (E3) | ○ | Δ | ○ |

EXAMPLES 32–39

Detergent compositions were prepared by blending 6 parts of (E1), 5 parts of propylene glycol, 0.4 part of Alcalase 2.5 L and 48.6 parts of water with each nonionic surfactant (B) and cationic surfactant (C) or salt (F) with or without polymer (A1) as shown in Table 5; and detergency, foam behavior and stability were evaluated.

The results are as shown in Table 5.

EXAMPLES 40 AND 41

Detergent compositions were prepared by blending 6 parts of (E1), 5 parts of propylene glycol, 0.4 part of Alcalase 2.5 L and 58.6 parts of water with polymer (A) or (A') and nonionic surfactant (B) shown in Table 3; and detergency, foam behavior and stability were evaluated.

The results are as shown in Table 3.

TABLE 5

| Example No. | (A1) parts | (B) kind | (B) parts | (C), (D), (F) kind | (C), (D), (F) parts | Detergency | Foam behavior | Stability |
|---|---|---|---|---|---|---|---|---|
| 32 | 5 | (Bn1) | 34.95 | (C1) | 0.05 | ◎ | Δ | ○ |
| 33 | 5 | (Bn5) | 34.8 | (C2) | 0.2 | ◎ | ○ | ○ |
| 34 | 5 | (Bn8) | 34 | (C3) | 1 | ◎ | ○ | ○ |
| 35 | 5 | (Bn18) | 30 | (C4) | 5 | ◎ | ○ | ○ |
| 36 | — | (Bn1) | 39.95 | (C5) | 0.05 | ○ | Δ | ○ |
| 37 | — | (Bn5) | 39.8 | (F1) | 0.2 | ○ | ○ | ○ |
| 38 | — | (Bn8) | 39 | (F2) | 1 | ○ | ○ | ○ |
| 39 | — | (Bn18) | 35 | (C6) | 5 | ○ | ○ | ○ |
| 40 | 2 | (Bn20) | 20 | (Dn1) | 10 | ◎ | Δ | ○ |
| 41 | 2 | — | — | (Dn1) | 30 | ○ | Δ | ○ |

COMPARATIVE EXAMPLES 1–9

Detergent compositions were prepared by blending 6 parts of (E1), 5 parts of propylene glycol, 0.4 part of Alcalase 2.5 L and 48.6 parts of water with each nonionic surfactant (B) and the other component (anionic surfactant of polymer) as shown in Table 6; and detergency, foam behavior and stability were evaluated.

The results are as shown in Table 6.

TABLE 6

| Comparative Example No. | (B) kind | (B) parts | Other components* kind | Other components* parts | Detergency | Foam behavior | Stability |
|---|---|---|---|---|---|---|---|
| 1 | (Bw1) | 10 | DBS | 30 | X | X | ○ |
| 2 | (Bw1) | 20 | (Dw1) | 20 | X | X | ○ |
| 3 | (Bw1) | 35 | (A'1) | 5 | ○ | Δ | X |
| 4 | (Bw1) | 35 | (A'2) | 5 | ○ | ○ | X |
| 5 | (Bn15) | 5 | (A'2) | 35 | Δ | Δ | X |
| 6 | (Bn15) | 90 | (A'2) | 5 | ○ | Δ | X |
| 7 | (Bn15) | 35 | (A'2) | 5 | Δ | Δ | X |
| 8 | (Bi) | 35 | PVA | 5 | Δ | Δ | X |
| 9 | (Bii) | 35 | PSS | 5 | Δ | Δ | X |

INDUSTRIAL APPLICABILITY

Detergent compositions according to the present invention have an excellent detergency, especially towards mud dirt in washing clothes, together with low foaming properties. Besides, the detergent compositions of this invention exhibit excellent effects when used for washing within washers capable of providing less damage to laundry, particularly a centrifugal washer.

What is claimed as new and desired to be secured by Letters patent is:

1. A liquid detergent composition, which comprises a surfactant and a builder and contains water in an amount of 10–80% by weight, at least 30% by weight of said builder containing a quaternary ammonium salt (A) of a carboxyl-containing polymer having a number average molecular weight of about 1,000 to about 100,000.

2. The composition of claim 1, wherein said polymer has a number average molecular weight of about 3,000 to about 30,000.

3. The composition of claim 1, wherein (A) has a solubility parameter of 8.0 to 12.0.

4. The composition of claim 1, wherein the carboxyl-containing polymer is a polymer of at least one monomer comprising at least 50 mole % of an ethylenically unsaturated carboxyl-containing monomer, with or without up to 50 mole % of at least one other polymerizable monomer; said carboxyl-containing monomer being at least one monomer selected from the group consisting of monocarboxylic acids, dicarboxylic acids, dicarboxylic anhydrides, and half esters of dicarboxylic acid; said other polymerizable monomer being at least one monomer selected from the group consisting of (a) ethylenically unsaturated aromatic hydrocarbon monomers, (b) ethylenically unsaturated aliphatic hydrocarbon monomers containing 2–20 carbon atoms, (c) ethylenically unsaturated alicyclic hydrocarbon monomers containing 5–15 carbon atoms, (d) ethylenically unsaturated esters, (e) ethylenically unsaturated monomers containing a hydroxyl group or a (poly)oxyalkylene group having a molecular weight of 44 to about 2000, (f) amide-containing ethylenically unsaturated monomers, (g) nitrile- or halogen-containing monomers and (h) ethylenically unsaturated monomers containing a sulfonic acid group or sulfate group.

5. The composition of claim 4, wherein said carboxyl-containing monomer is acrylic acid or methacrylic acid.

6. The composition of claim 1, wherein said salt has a quaternary ammonium cation represented by the general formula:

(1)

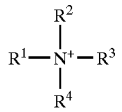

wherein $R^1$ is selected from the group consisting of aliphatic hydrocarbyl groups containing 1–18 carbon atoms, cycloalkyl groups containing 4–12 carbon atoms and benzyl group; $R^2$, $R^3$ and $R^4$ are independently selected from the group consisting of aliphatic hydrocarbyl groups containing 1–18 carbon atoms, hydroxyalkyl groups containing 2 to 8 carbon atoms and polyoxyalkylene group represented by a formula: —($A^1$O)n-Z, wherein $A^1$ is an alkylene group containing 2–4 carbon atoms, Z is a hydrogen atom or an acyl group containing 1–18 carbon atoms, n is an integer of 2 to 50; or two or three of $R^2$, $R^3$ and $R^4$ are joined to form a heterocyclic ring together with the quaternary nitrogen atom.

7. The composition of claim 6 wherein the quaternary ammonium cation is at least one cation selected from the group consisting of tetraalkylammonium cations, cycloalkyltrialkylammonium cations, and alkyltrihydroxyalkylammonium cations.

8. The composition of claim 1, wherein the surfactant is a nonionic surfactant (B) and the composition comprises 1 to 30% by weight of (A), 10 to 95% by weight of the nonionic surfactant (B) and 10 to 80% by weight of water.

9. The composition of claim 8, wherein (B) comprises at least one nonionic surfactant selected from the group consisting of (poly)oxyalkylene ethers of aliphatic alcohol containing 8–18 carbon atoms, (poly)oxyalkylene ethers of alkylphenol containing 1–12 carbon atoms in the alkyl group, (poly)oxyalkylene esters of fatty acid containing 8–18 carbon atoms, (poly)oxyethylene ethers of polyoxypropylene polyol having an equivalent weight of 100 to 2000, polyoxyalkylene alkyl allyl ethers containing 6–20 carbon atoms in the alkyl group, (poly)oxyalkylene ethers of polyhydric alcohol ester of fatty acid containing 8–24 carbon atoms, polyhydric alcohol esters of fatty acid containing 8–24 carbon atoms, and alkanolamides of fatty acid containing 8–24 carbon atoms.

10. The composition of claim 9, wherein (B) is an alkylene oxide adduct represented by the general formula:

$$R—O—(A^1O)p\text{-}H \quad (2)$$

wherein R is an aliphatic hydrocarbyl group containing 8–18 carbon atoms, p is an integer of 1–30 and $A^1$ is an alkylene group containing 2–4 carbon atoms.

11. The composition of claim 9, wherein (B) is an alkylene oxide adduct represented by the general formula:

$$RO—\{(C_2H_4O)n.(A^2O)m\}—(C_2H_4O)q\text{-}(A^2O)r\text{-}H \quad (3)$$

wherein R is an aliphatic hydrocarbyl group containing 8–18 carbon atoms, $A^2$ is an alkylene group containing 3–4 carbon atoms, n is 0 or an integer of 1–12, m is 0 or an integer of 1–6, q is an integer of 1–16, r is 0 or an integer of 1–15, (m+n+q) is an integer of 1–30, (n+q)/(m+n+q+r) is at least 0.5, and $\{(C_2H_4O)n.(A^2O)m\}$ in case of n being not equal to 0 represents $(C_2H_4O)$ and $(A^2O)$ being present either random-wise or block-wise.

12. The composition of claim 9, wherein (B) is an alkylene oxide adduct (Bn) prepared by adding an alkylene oxide (b1) to an aliphatic alcohol (a1), said adduct satisfying the following inequality (I) or (II) and having a distribution constant (c) of 2.0 or less calculated by the following equation (III):

$$Mw/Mn \leqq 0.030Ln(v)+1.010 (v<10) \quad (I)$$

$$Mw/Mn \leqq -0.026Ln(v)+1.139 (v \geqq 10) \quad (II)$$

$$c=(v+n_o/n_{oo}-1)/\{Ln(n_{oo}/n_o)+n_o/n_{oo}-1\} \quad (III)$$

wherein Mw is a weight average molecular weight, Mn is a number average molecular weight, v is the average addition molar number of (b1) added to 1 mole of (a1), $n_{oo}$ is the molar number of (a1) used in the reaction, and $n_o$ is the molar number of the unreacted (a1).

13. A liquid detergent composition, which comprises: (i) 1 to 30% by weight of a quaternary ammonium salt (A) of a carboxyl-containing polymer having a number average molecular weight of about 1,000 to about 100,000; (ii) 10 to 95% by weight of a nonionic surfactant (B); (iii) 0.01 to 10% by weight of at least one cationic surfactant (C) selected from the group consisting of quaternary ammonium salt type cationic surfactants and amine salt type cationic surfactants; and (iv) 10 to 80% by weight of water.

14. The composition of claim 13 wherein (C) is at least one compound represented by the general formula (7) or (8):

(7)

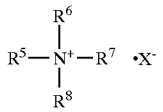

(8)

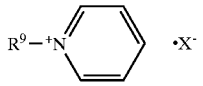

wherein $R^5$ is an organic group, selected from the group consisting of aliphatic hydrocarbyl, acyloxyalkyl, acylaminoalkyl, alkoxyalkyl and hydroxyalkyl groups, containing 8–24 carbon atoms; $R^6$ and $R^7$ are independently selected from the group consisting of hydrogen atom, aliphatic hydrocarbyl groups containing 1–24 carbon atoms, hydroxyalkyl groups containing 2 to 24 carbon atoms and polyoxyalkylene group represented by a formula: —($A^1$O)n-Z; $R^8$ is selected from the group consisting of hydrogen atom, aliphatic hydrocarbyl groups containing 1–24 carbon atoms, benzyl group, hydroxyalkyl groups containing 2 to 24 carbon atoms and polyoxyalkylene group represented by a formula: —($A^1$O)n-Z, wherein $A^1$ is an alkylene group containing 2–4 carbon atoms, Z is a hydrogen atom or an acyl group containing 1–18 carbon atoms and n is an integer of 2 to 50; $R^9$ is an organic group, selected from the group consisting of aliphatic hydrocarbyl, acyloxymethyl and alkoxymethyl groups, containing 8–24 carbon atoms and X is an anionic counter ion.

15. The composition of claim 1, which further contains 0.1 to 20% by weight of a quaternary ammonium or organic amine salt (E) of a polycarboxylic acid having a number average molecular weight lower than that of the carboxyl-containing polymer in (A).

16. A method of washing, which comprises washing fibrous material, fabrics or clothes with a detergent composition according to claim 1.

* * * * *

UNITED STATES PATENT AND TRADEMARK OFFICE

CERTIFICATE OF CORRECTION

PATENT NO. : 6,680,286 B1 
DATED : January 20, 2004
INVENTOR(S) : Koji Kawaguchi et al.

It is certified that error appears in the above-identified patent and that said Letters Patent is hereby corrected as shown below:

Column 29,
Line 55, "RO-{($C_2H_4O$)n.($A^2O$)m}-($C_2H_4O$)q-($A^2O$)r-H" should read -- RO-{($C_2H_4O$)n·($A^2O$)m}-($C_2H_4O$)q-($A^2O$)r-H --.
Line 62, "{($C_2H_4O$)n.($A^2O$)m}" should read -- {($C_2H_4O$)n·($A^2O$)m} --.

Column 30,
Line 55, after "carbon atoms", insert -- ; --.

Signed and Sealed this

Thirty-first Day of August, 2004

JON W. DUDAS
*Director of the United States Patent and Trademark Office*